US010715909B1

(12) United States Patent
Tourbabin et al.

(10) Patent No.: US 10,715,909 B1
(45) **Date of Patent: *Jul. 14, 2020**

(54) DIRECT PATH ACOUSTIC SIGNAL SELECTION USING A SOFT MASK

(71) Applicant: FACEBOOK TECHNOLOGIES, LLC, Menlo Park, CA (US)

(72) Inventors: Vladimir Tourbabin, Sammamish, WA (US); Ravish Mehra, Tacoma, WA (US)

(73) Assignee: FACEBOOK TECHNOLOGIES, LLC, Menlo Park, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/215,473

(22) Filed: Dec. 10, 2018

Related U.S. Application Data

(63) Continuation-in-part of application No. 15/947,502, filed on Apr. 6, 2018.

(51) Int. Cl.

| | |
|---|---|
| ***H04R 3/00*** | (2006.01) |
| ***H04R 1/40*** | (2006.01) |
| ***G10L 25/18*** | (2013.01) |

(52) U.S. Cl.
CPC ..... *H04R 3/005* (2013.01); *G10L 25/18* (2013.01); *H04R 1/406* (2013.01)

(58) Field of Classification Search
CPC .. H04R 3/005; H04R 1/406; H04R 2201/401; H04R 3/00
USPC ..... 381/92, 385, 91, 355, 376, 381, 388
See application file for complete search history.

(56) References Cited

U.S. PATENT DOCUMENTS

2016/0142830 A1* 5/2016 Hu ..... G02C 11/06 434/185
2017/0257723 A1* 9/2017 Morishita ..... H04R 5/033

OTHER PUBLICATIONS

Nadiri et al., "Localization of Multiple Speakers under High Reverberation using a Spherical Microphone Array and the Direct-Path Dominance Test", IEEE/ACM Transactions on Audio, Speech, and Language Processing, vol. 22, No. 10, Oct. 2014, pp. 1494-1505.
Rafaely et al., "Speaker localization using direct path dominance test based on sound field directivity", Signal Processing, vol. 143, 2018, pp. 42-47.
Hafezi et al., "Multiple Source Localization using Estimation Consistency in the Time-Frequency Domain", IEEE International Conference on Acoustics, Speech and Signal Processing (ICASSP), Mar. 2017, pp. 516-520.

(Continued)

*Primary Examiner* — Thjuan K Addy
(74) *Attorney, Agent, or Firm* — Artegis Law Group, LLP

(57) ABSTRACT

One embodiment of the present application sets forth a computer-implemented method that includes receiving, from a first microphone, a first input acoustic signal, generating a first audio spectrum from at least the first input acoustic signal, where the first audio spectrum includes a set of time-frequency bins, for each time-frequency bin included in the set of time-frequency bins, computing a weighted local space-domain distance (LSDD) spectrum value based on a portion of the first audio spectrum that is included in the time-frequency bin, generating a combined spectrum value based on a set of the weighted LSDD spectrum values computed for the set of time-frequency bins, and determining a first estimated direction of the first input acoustic signal based on the combined spectrum value.

20 Claims, 11 Drawing Sheets

(56) References Cited

OTHER PUBLICATIONS

Tourbabin et al., "Speaker Localization by Humanoid Robots in Reverberant Environments", IEEE 28th Convention of Electrical Electronics Engineers (IEEEI), Dec. 2014, 5 pages.
Ding et al., "DOA estimation of multiple speech sources by selecting reliable local sound intensity estimates", Applied Acoustics, vol. 127, 2017, pp. 336-345.
Tourbabin et al., "Theoretical Framework for the Optimization of Microphone Array Configuration for Humanoid Robot Audition", IEEE/ACM Transactions on Audio, Speech, and Language Processing, vol. 22, No. 12, Dec. 2014, pp. 1803-1814.
Maazaoui et al., "Adaptive blind source separation with HRTFs beamforming preprocessing", IEEE 7th Sensor Array and Multichannel Signal Processing Workshop (SAM), Jun. 2012, pp. 269-272.
Stoica et al., "Maximum Likelihood Methods for Direction-of-Arrival Estimation", IEEE Transactions on Acoustics, Speech, and Signal Processing, vol. 38, No. 7, Jul. 1990, pp. 1132-1143.
Schmidt, Ralph O., "Multiple Emitter Location and Signal Parameter Estimation", IEEE Transactions on Antennas and Propagation, vol. AP-34, No. 3, Mar. 1986, pp. 276-280.
Harmanci et al., "Relationships between Adaptive Minimum Variance Beamforming and Optimal Source Localization", IEEE Transactions on Signal Processing, vol. 48, No. 1, Jan. 2000, pp. 1-12.
Farina, Angelo, "Simultaneous measurement of impulse response and distortion with a swept-sine technique", Audio Engineering Society Convention, vol. 108, Feb. 2000, pp. 1-24.
EBU SQAM CD, "Sound Quality Assessment Material recordings for subjective tests", EBU Tech 3253, 2008, 13 pages.

* cited by examiner

DIRECT PATH ACOUSTIC SIGNAL SELECTION USING A SOFT MASK

CROSS-REFERENCE TO RELATED APPLICATIONS

This application is a continuation-in-part of the co-pending U.S. patent application titled, "TECHNIQUES FOR SELECTING A DIRECT PATH ACOUSTIC SIGNAL," filed on Apr. 6, 2018 and having Ser. No. 15/947,502. The subject matter of this related application is hereby incorporated herein by reference.

BACKGROUND

Field of the Various Embodiments

Embodiments of the present disclosure relate generally to audio processing and, more specifically, to techniques for direct path acoustic signal selection using a soft mask.

Description of the Related Art

Near-eye displays (NED) are used in certain instances to simulate virtual environments or to add virtual elements to real environments, such as providing virtual reality (VR), augmented reality (AR), and/or mixed reality (MR) content to a user. When providing AR content to a viewer, the NED provides computer-generated perceptual information, in addition to a direct or indirect live view of a physical, real-world environment. When providing AR content to a user, the NED may provide visual, auditory, and haptic content to the computer-generated information.

When providing auditory content in relation to the AR content, a NED may analyze the surrounding acoustic environment in which the NED is located. One technique conventional VR NEDs implement when analyzing an acoustic environment is a direction-of-arrival (DOA) estimation of direct-path signal. The NED implements a DOA estimation to determine the direction from which a propagating wave of an acoustic signal arrives at the NED. However, reflections and reverberations within the surrounding acoustic environment make determining the direction of an acoustic source difficult using conventional DOA estimation systems. Furthermore, some systems are computationally demanding in order to accurately perform DOA estimation.

SUMMARY

One embodiment of the present application sets forth a computer-implemented method that includes receiving, from a first microphone, a first input acoustic signal, generating a first audio spectrum from at least the first input acoustic signal, wherein the first audio spectrum includes a set of time-frequency bins, for each time-frequency bin included in the set of time-frequency bins, computing a weighted local space-domain distance (LSDD) spectrum value based on a portion of the first audio spectrum that is included in the time-frequency bin, generating a combined spectrum value based on a set of the weighted LSDD spectrum values computed for the set of time-frequency bins, and determining a first estimated direction of the first input acoustic signal based on the combined spectrum value.

At least one advantage of the disclosed embodiments is that the LSDD soft masker provides a technological improvement of effectively weighting specific time-frequency bins within an acoustic spectrum to determine a direction of an acoustic source. The LSDD soft masker weighs time-frequency bins that contain dominant direct-path signals more heavily than other time-frequency bins. The LSDD soft masker effectively focuses on specific portions of the acoustic spectrum without requiring computationally-intensive signal processing techniques or losing information via a binary masking technique. By computing the local space-domain distance for each TF bin individually, the local space domain distance selector enables a NED to perform DOA estimation in a computationally-efficient manner, while maintaining accuracy.

BRIEF DESCRIPTION OF THE DRAWINGS

So that the manner in which the above recited features of the various embodiments can be understood in detail, a more particular description of the inventive concepts, briefly summarized above, may be had by reference to various embodiments, some of which are illustrated in the appended drawings. It is to be noted, however, that the appended drawings illustrate only typical embodiments of the inventive concepts and are therefore not to be considered limiting of scope in any way, and that there are other equally effective embodiments.

DETAILED DESCRIPTION

Figure 1:
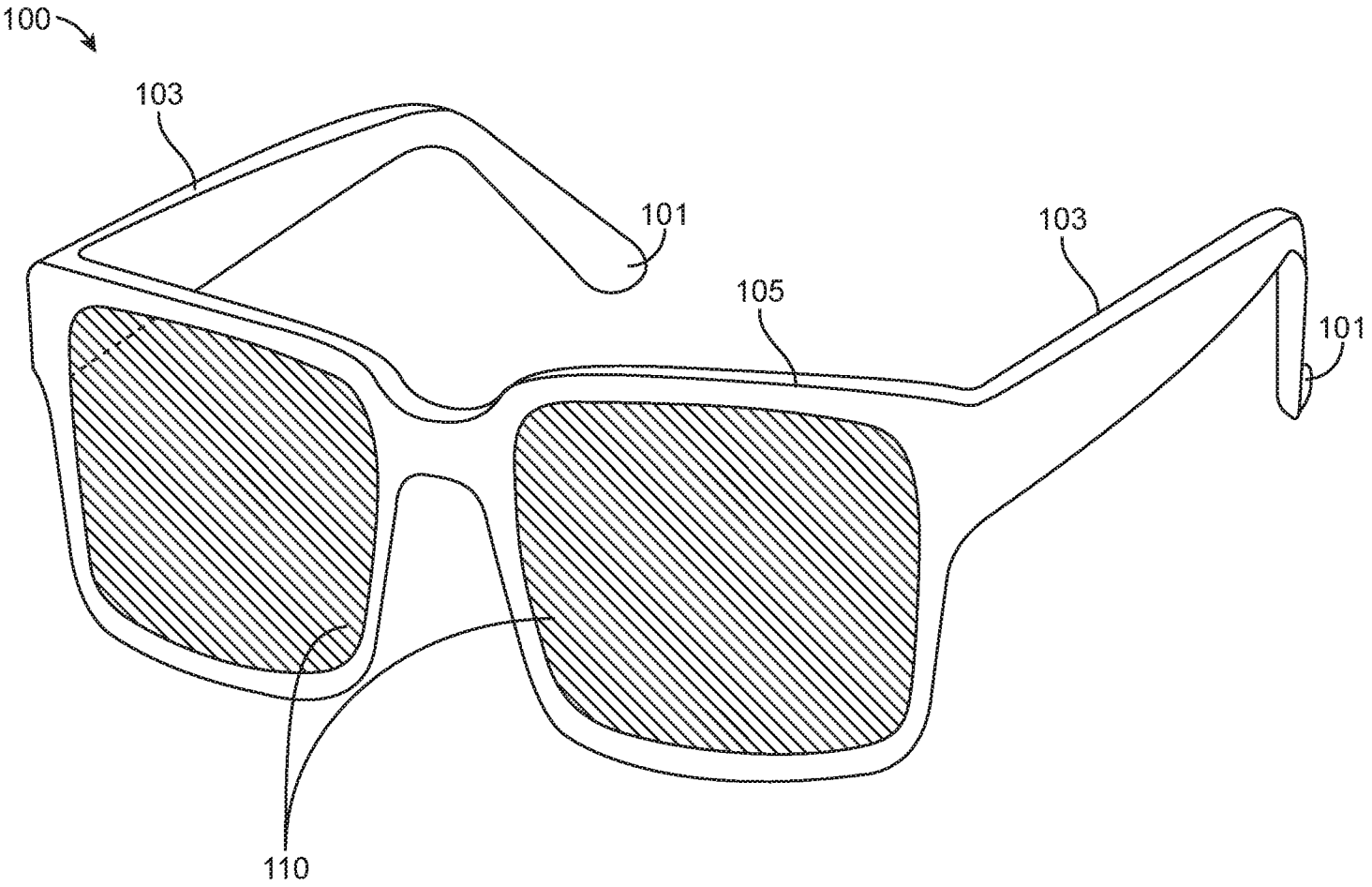
FIG. 1 is an illustration of a near-eye display (NED) configured to implement one or more aspects of the present disclosure.

In the following description, numerous specific details are set forth to provide a more thorough understanding of the various embodiments. However, it will be apparent to one of skilled in the art that the inventive concepts may be practiced without one or more of these specific details.

As discussed above, some DOA estimation systems receive input acoustic signals from a microphone array, convert the acoustic signals into the short-time Fourier transform (STFT) domain, and filter portions of the time-frequency (TF) domain to process. Some DOA estimation systems perform direct sound selection (DSS) to select the portions of the TF domain to process. For example, some DOA estimation systems perform binary masking by selecting one or more TF bins that are dominated by a direct-path signal, while rejecting other TF bins that are contaminated with noticeable levels of reflection signals. One of the drawbacks of certain binary masking techniques is that selection of the direct-path TF bins is computationally demanding. For example some methods of selecting certain TF bins require multiple complex computational steps, such as spherical Fourier transformation and matrix decomposition, to apply direct-path signal determination tests on the TF bins. In addition, these DOA estimation systems impose structural limitations, such as requiring the microphone array to be spherical, in order to accurately perform the DOA estimation systems. Further, performing binary masking on the STFT domain may discard other information, such as residual information about the direction of arrival.

Embodiments of the disclosure may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely-generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a head-mounted display (HMD) or near-eye display (NED) connected to a host computer system, a standalone HMD or NED, a mobile device or computing system, or any other hardware platform capable of providing artificial reality content to one or more viewers.

FIG. 1 is an illustration of a near-eye display (NED) 100 configured to implement one or more aspects of the present disclosure. In various embodiments, NED 100 presents media to a user. The media may include visual, auditory, and haptic content. In some embodiments, NED 100 provides artificial reality (e.g., augmented reality [AR]) content by providing both a real-world environment and/or computer-generated content. In some embodiments, the computer-generated component of the AR content may include visual, auditory, and haptic information. In some embodiments, auditory information is presented via an external device (e.g., speakers and/or headphones) that receives the auditory information from NED 100.

NED 100 includes headphones 101, microphone array 103, frame 105, and display 110. In various embodiments, the NED 100 may include one or more additional elements. Headphones 101, microphone array 103, and/or display 110 may be positioned at different locations on the NED 100 than the locations illustrated in FIG. 1. Headphones 101 and/or display 110 are configured to provide content to the user, including audiovisual content.

Microphone array 103 includes one or microphones housed within frame 105 of NED 100. Microphone array 103 may be arranged in any number of configurations. Each microphone included in microphone array 103 may be configured to receive audio signals from an environment. In some embodiments, the audio signals may include speech from the user. In some embodiments, the audio signals may include a target, direct-path signal and one or more reflected sound. Display 110 may be positioned at different locations on the NED 100 than the locations illustrated in FIG. 1. Display 110 is configured to provide content to the user, including audiovisual content. In some embodiments, one or more displays 110 may be located within frame 105.

NED 100 further includes an eye tracking system and one or more corresponding modules. The modules may include emitters (e.g., light emitters) and/or sensors (e.g., image sensors, cameras). In various embodiments, the modules are arranged at various positions along the inner surface of the frame 105, so that the modules are facing the eyes of a user wearing the NED 100. For example, the modules could include emitters that emit structured light patterns onto the eyes and image sensors to capture images of the structured light pattern on the eyes. As another example, the modules could include multiple time-of-flight sensors for directing light at the eyes and measuring the time of travel of the light at each pixel of the sensors. As a further example, the modules could include multiple stereo depth sensors for capturing images of the eyes from different vantage points. In various embodiments, the modules also include image sensors for capturing 2D images of the eyes.

Figure 2:
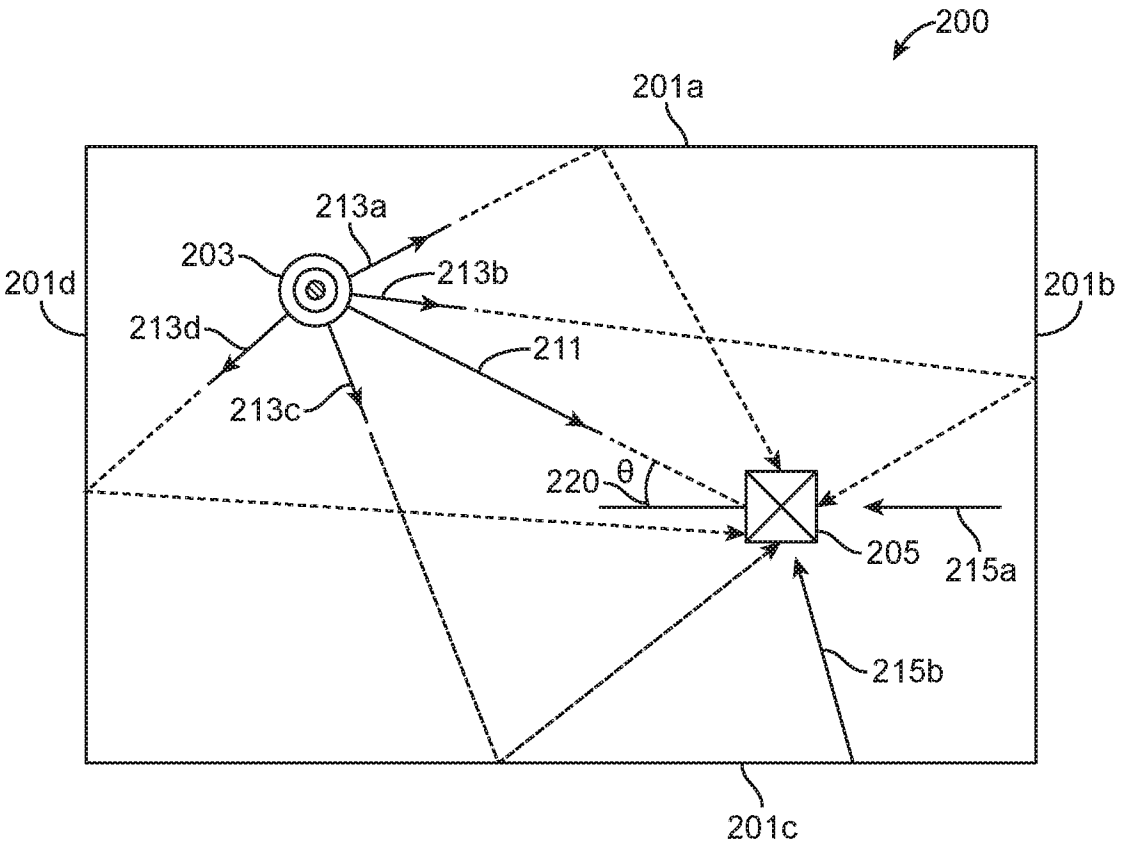
FIG. 2 is an illustration of an acoustic environment including the NED of FIG. 1, according to various embodiments of the present disclosure.

FIG. 2 is an illustration of an acoustic environment 200 including the NED 100 of FIG. 1, according to various embodiments of the present disclosure. Acoustic environment 200 includes walls 201*a-d*, acoustic source 203, and target 205. An audio spectrum in acoustic environment 200 includes direct path acoustic signal 211, reflected path acoustic signals 213*a-d*, and noise signals 215*a-b*.

Acoustic source 203 may be any person, device, or other object that generates a sound within acoustic environment 200. Acoustic source 203 may generate a sound that emanates through a sound propagation wave. The sound propagation wave includes multiple acoustic signals, including direct path acoustic signal 211 that transmits the sound in the direction of target 205. The sound propagation wave also includes one or more reflected path acoustic signals 213*a-d*. Each reflected path acoustic signal may reflect on one or more walls 201*a-d* included in acoustic environment 200 before reaching target 203.

Target 205 may be a user that is operating NED 100. During operation, microphone array 103 of NED 100 may receive acoustic signals 211-215. When implementing an AR application, NED 100 may implement a direction-of-arrival (DOA) estimation to determine the relative direction of direct path signal 211 originating from acoustic source 203. In some embodiments, NED 100 may implement DOA estimation techniques to filter out reflected path acoustic signals 213*a-d* and/or noise signals 215*a-b*. Noise signals 215*a-b* may represent other sounds in acoustic environment 200 that do not originate from acoustic source 203 or target 205.

When NED 100 implements a DOA estimation to determine the direction of direct path signal 211, NED 100 may not be able to filter out all of reflected path acoustic signals 213*a-d* and/or noise signals 215*a-b*. Microphone array 103 in NED 100 may receive an audio spectrum that includes direct path acoustic signal 211, reflected path acoustic signals 213*a-d*, and noise signals 215*a-b*. In such instances, NED 100 may implement spectrum analysis techniques to select one or more portions of the audio spectrum for further processing in order to determine direct-path acoustic signal 211 and determine an angle 220 that indicates the direction of direct-path acoustic signal 211. In some embodiments, NED 100 may use the determined angle 220 to locate acoustic source 203.

DOA Estimation Using a Binary Mask

Figure 3:
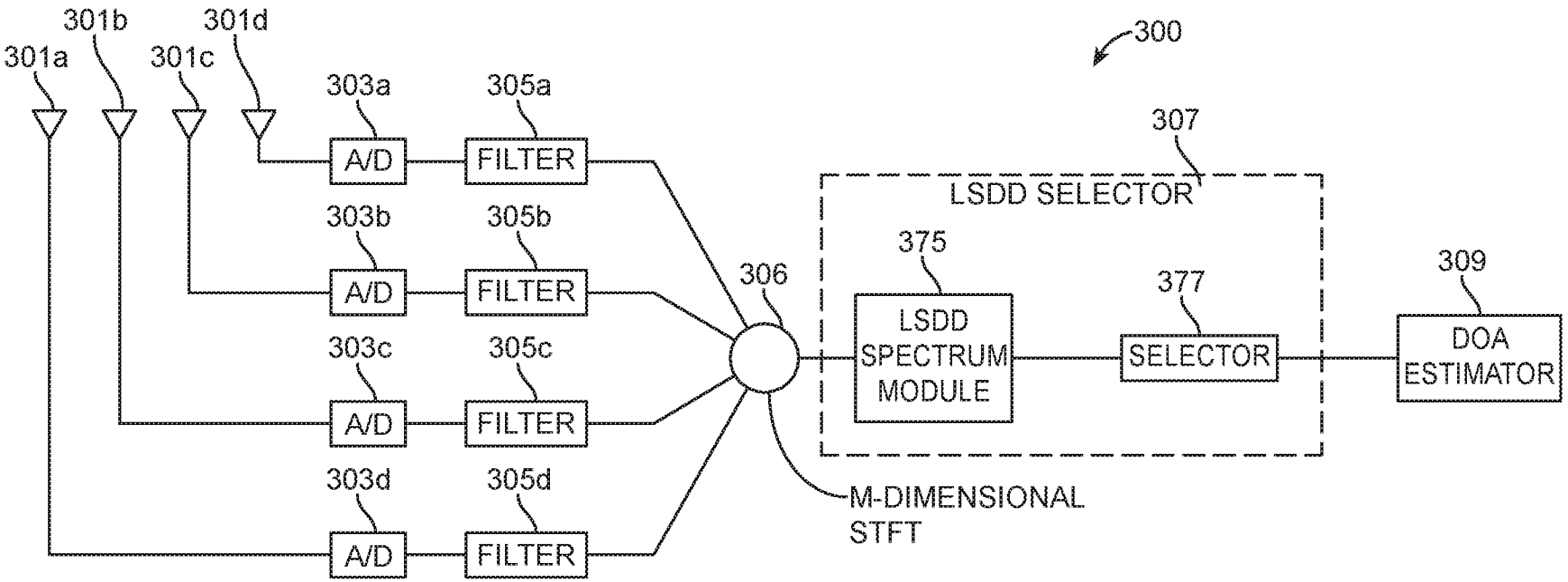
FIG. 3 is a detailed illustration of a direction-of-arrival (DOA) estimation device included in the NED of FIG. 1, according to various embodiments of the present disclosure.

FIG. 3 is a detailed illustration of a direction-of-arrival (DOA) estimation device 300 included in the NED 100 of FIG. 1, according to various embodiments of the present disclosure. DOA estimation device 300 includes microphones 301*a-d*, analog/digital (A/D) converters 303*a-d*, filters 305*a-d*, M-dimensional short-time Fourier transfer (STFT) 306, local space-domain distance (LSDD) selector 307, and DOA estimator 309. The LSDD selector 307 includes an LSDD spectrum module 375 and selector 377.

DOA estimation device 300 may be a component of NED 100 that receives audio signals and determines the direction of direct-path acoustic signal 211 included in the audio spectrum. In some embodiments, DOA estimation device 300 may include hardware and/or software to process the received set of audio signals to determine what part of the received audio signal is the direct-path acoustic signal 211, and also determine the direction of the direct-path acoustic signal 211, where the direction is determined as a relative angle 220 from which microphone array 103 received the direct-path acoustic signal 211.

The front-end of DOA estimation device 300 includes one or more microphones 301*a-d*, one or more A/D converters 303*a-d*, and one or more filters 305*a-d*. In some embodiments, the front-end of DOA estimation device 300 may include two or more parallel or substantially-parallel paths, where each parallel path is connected to a separate microphone 301*a-d* in microphone array 103 of NED 100. Each of microphones 301*a-d* may receive multiple audio signals, including direct-path acoustic signal 211, reflected-path acoustic signals 213*a-d*, and/or noise signals 215*a-b*. Each of A/D converters 303*a-d* converts the received audio signal from respective microphone 301*a-d* into a digital signal. Each of filters 305*a-d* may filter some of the digital audio received from respective A/D converters 303*a-d* to remove some noise from the signal. In some embodiments, filters 303*a-d* may be a high-pass filter, a low-pass filter, and/or a bandpass filter.

M-dimensional Short-time Fourier transform (STFT) 306 receives an M-channel signal from filters 305*a-d* and transforms the M-channel signal into the STFT domain. The transform of the M-channel audio signal is the audio spectrum, with each time-frequency (TF) bin included in the audio spectrum represented as audio/complex-valued vectors. Each vector in the transform includes an array manifold (i.e., steering vector) reflecting the array response to a unit-amplitude sound wave at a defined frequency arriving at a particular angle. Each vector is also associated with a scalar quantity that denotes the amplitude of the vector arriving at the particular angle. In some embodiments, the scalar quantity includes a source amplitude, one or more reflections, a distance-dependent phase, and a distance-dependent amplitude. The transform includes multiple vectors, with each vector being multiplied by a scalar quantity.

Local space-domain distance (LSDD) selector 307 included in DOA estimation device 300 performs direct sound selection (DSS) via binary masking. LSDD selector 307 receives one or more TF bins from M-dimensional STFT 306 and transmits one or more selected TF bins to DOA estimator 309 for DOA estimation. As will be discussed in further detail, M-dimensional STFT 306 receives the separate digital audio signals and generates the audio spectrum. LSDD selector 307 separately processes each of the TF bins included in the audio spectrum. For each of the separately-processed TF bins, LSDD selector 307 determines whether the TF bin includes a portion of the audio spectrum with a distinguished direct-path audio signal 211. LSDD selector 307 transmits to DOA estimator 307 the TF bins that include the distinct presence of direct-path acoustic signal 211.

In some embodiments, for a given TF bin, LSDD spectrum module 375 within LSDD selector 307 computes a LSDD spectrum. The local space-domain distance for a given TF bin reflects the amplitude of the spatial spectrum as a function of the angle at which microphone array 103 received the acoustic signal. In some embodiments, the angle at which microphone array 103 receives the acoustic signal includes both the elevation angle and azimuth angle. In some embodiments, LSDD spectrum module 375 computes the LSDD spectrum as a function of the TF bin, $X_{\tau,\nu}$, and the array manifold for the audio signals, $V_\nu$. Equation 1 illustrates the relationship between the LSDD spectrum, $S_{\tau,\nu}(\theta)$, the TF bin, and the array manifold:

$$S_{\tau,\nu}(\theta)=1/d(X_{\tau,\nu}V_\nu(\theta)) \quad (1)$$

In some embodiments, d(X, V) measures the similarity between two vectors, such as the sine of the angle between the two vectors. In some embodiments, an ideal TF bin includes only the direct-path acoustic signal 211, so that d(X, V) for the TF bin is equal to 0 and the LSDD has an infinite peak. In some embodiments, the d(X, V) for a TF bin is small, resulting in a large LSDD spectrum value, indicating a TF bin with a dominant direct-path acoustic signal 211.

Selector 377 within LSDD selector 307 applies a binary mask to each TF bin. For a given TF bin, selector 377 applies the binary mask by evaluating the TF bin to determine whether to select the TF bin (e.g., apply a weight value equal to "1") for DOA estimation by DOA estimator 309. Selector 377 evaluates a TF bin by determining a local spectrum value $L_{sp}$ for that TF bin. The $L_{sp}$ for a given TF bin represents a peak-to-noise ratio reflecting a comparative strength of direct-path acoustic signal 211 to other acoustic signals included the LSDD spectrum within a given TF bin. Unlike other evaluation methods that average the local spectrum value across all TF bins, selector 377 computes each local spectrum value separately.

Selector 377 then uses the computed local spectrum value to determine whether the given TF bin should be transmitted to DOA estimator 309 for further processing. When determining whether the given TF bin should be transmitted to DOA estimator 309, selector 377 compares the local spectrum value to a pre-determined threshold to determine whether the local spectrum value exceeds the pre-determined threshold. When the local spectrum value exceeds the pre-determined threshold, selector 377 may transmit the given TF bin to DOA estimator 309. In some embodiments, selector 377 applies a weight value of 1 to a selected TF bin and applies a weight value of 0 to a non-selected TF bin. In such instances, DOA estimator 309 only receives non-zero values from selected TF bins.

DOA estimator 309 implements DOA estimation on the one or more selected TF bins, received from LSDD selector 307. In some embodiments, DOA estimator may compile the estimated direction computed for each received TF bin to compute an estimated angle 220. In some embodiments, the computation of spatial spectra for all TF bins may be implemented in parallel. In some embodiments, DOA estimator 309 may transmit estimated angle 220 to a different component of NED 100, which may incorporate estimated angle 220 when implementing an AR application.

Figure 4:
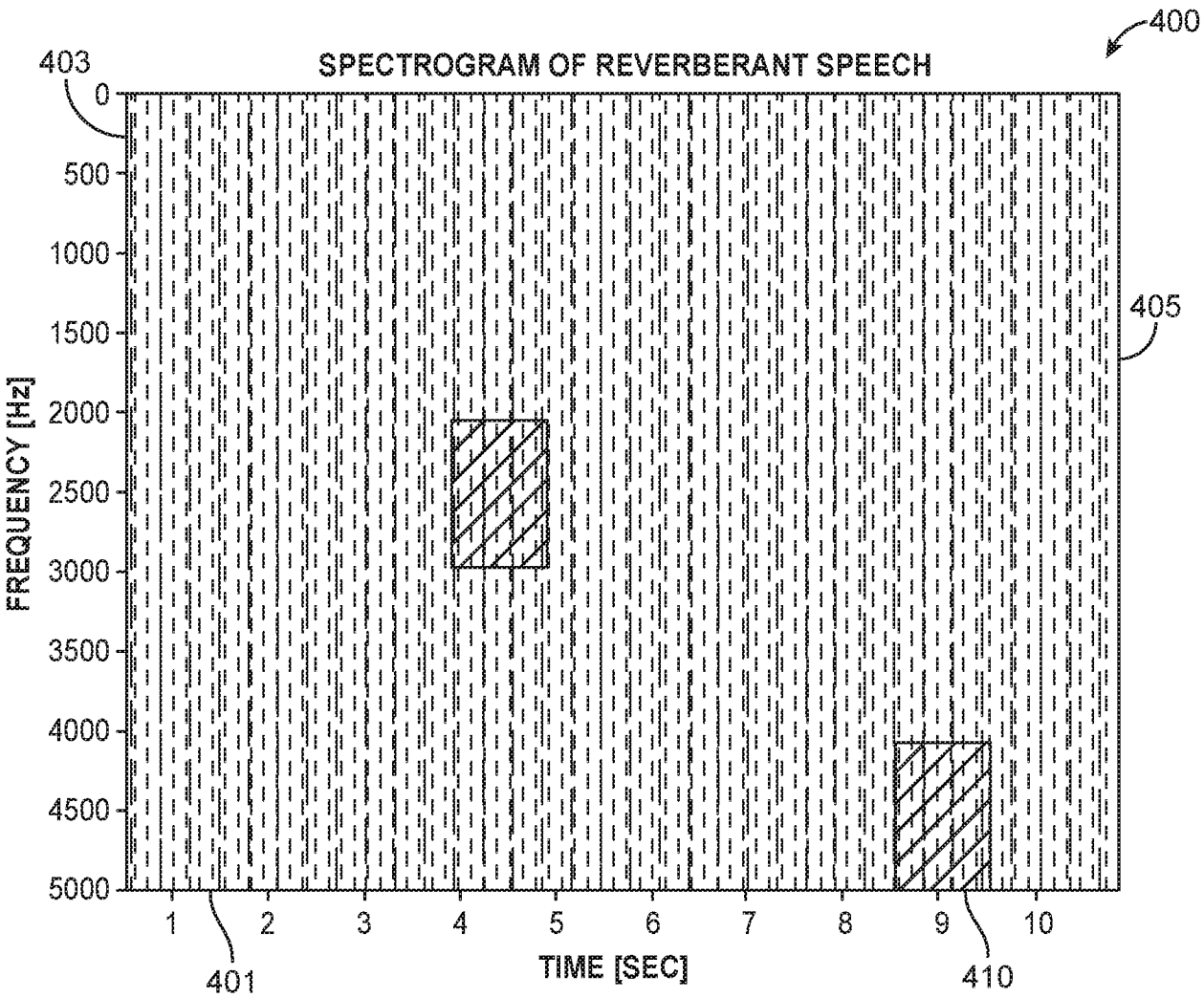
FIG. 4 is an illustration of multiple time-frequency (TF) bins included in the acoustic spectrum, according to various embodiments of the present disclosure.

FIG. 4 is an illustration of a multiple time-frequency (TF) bins included in the audio spectrum, according to various embodiments of the present disclosure. Graph 400 includes a spectrograph of the audio spectrum 405 as a function of time 401 and frequency 403. TF bin 410 includes a portion of audio spectrum 405 for processing by LSDD spectrum module 375 and/or selector 377 of LSDD selector 307.

As discussed above, M-dimensional STFT 306 generates audio spectrum 405. In some embodiments, audio spectrum 405 may include the audio spectrum of the audio signals received by microphone array 103. In some embodiments, each TF bin 410 of audio spectrum 405 includes one or more of direct-path acoustic signal 211, reflected-path acoustic signals 213*a-d*, and/or noise signals 215*a-b*. In some embodiments, each TF bin 410 has differing concentrations of each of the respective audio signals 211-215. Selector 377 of LSDD selector 307 is configured to separately process each of TF bins 410 and apply a binary mask to each of the TF bins 410, selecting only the TF bins 410 that have a relatively high concentration of direct-path acoustic signal 211. In some embodiments, DOA estimator 309 may implement DOA estimations on only the TF bins 410 selected by LSDD selector 307 to generate an estimated angle 220 of acoustic source 203.

Figure 5:
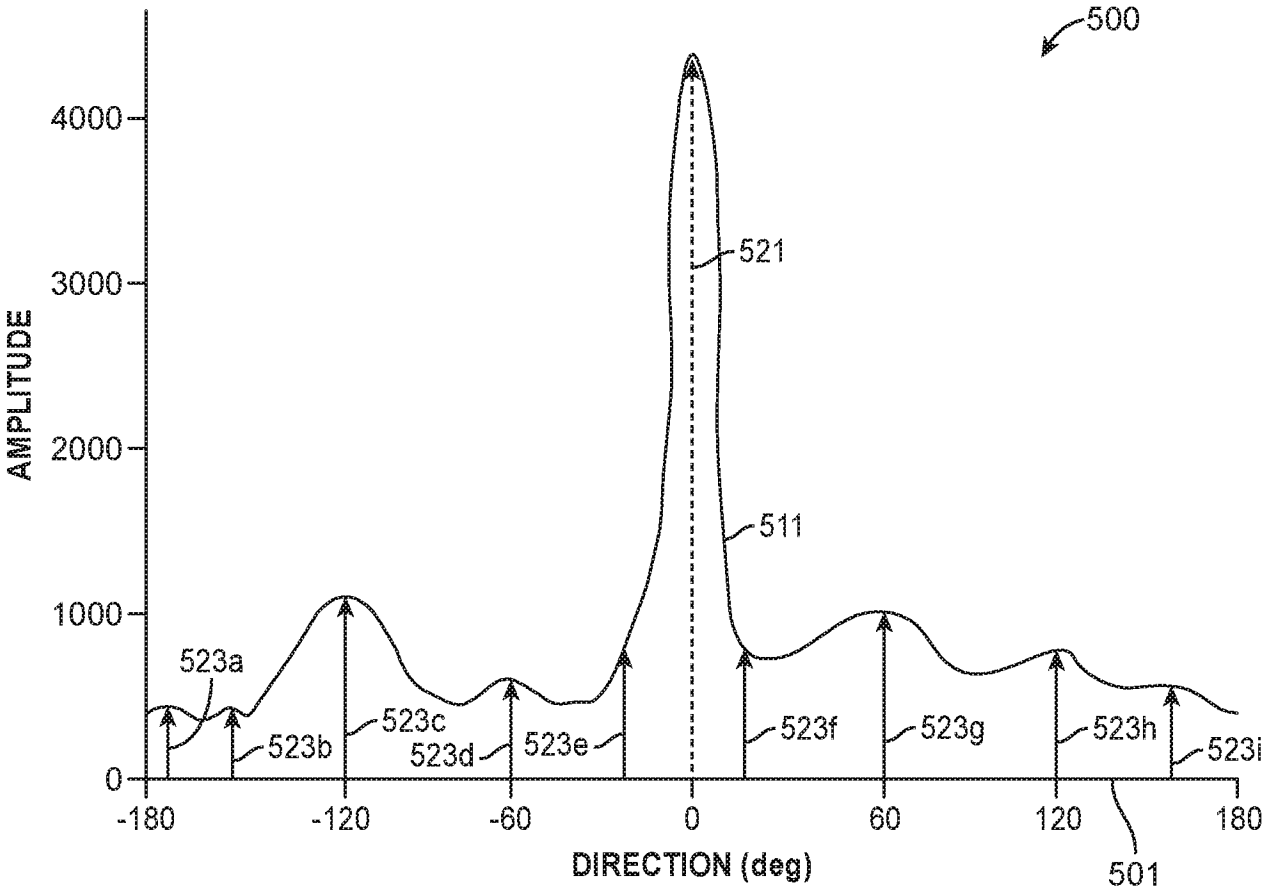
FIG. 5 is an illustration a local space-domain distance (LSDD) estimation for a target TF bin of FIG. 4, according to various embodiments of the present disclosure.

FIG. 5 is an illustration of an LSDD spectrum for a given TF bin 410 of FIG. 4, according to various embodiments of the present disclosure. Graph 500 includes LSDD (spatial) spectrum 511 as a function of acoustic source direction 501 (x axis) and amplitude 503 (y axis). LSDD spectrum 511 includes a maximum peak 521 and a set of secondary peaks 523*a-i*.

In some embodiments, LSDD spectrum module 375 computes LSDD spectrum 511 for a given TF bin 410 received from M-dimensional STFT 306. Upon computing LSDD spectrum 511, LSDD spectrum module 375 transmits to selector 377 the TF bin that includes the LSDD spectrum 511. When selector 377 determines whether to transmit the given TF bin 410 to DOA estimator 309, selector 377 first computes a local spectrum value for the LSDD spectrum 511. Selector 377 then compares the local spectrum value to a pre-determined threshold.

In some embodiments, when computing the local spectrum value, selector 377 determines the maximum peak 521 of LSDD spectrum 511, along with a set of secondary peaks 523*a-i*. In such instances, the local spectrum value is similar to a peak-to-noise ratio for LSDD spectrum 511, reflecting the comparative strength of direct-path acoustic signal 211 to other signals and noise in LSDD spectrum 511. Equation 2 illustrates the local spectrum value as a ratio of the maximum peak 521 of the scalar quantity, $S_{max}$, compared to the average of secondary peaks 523*a-i* of the scalar quantity, $S(\theta_i)$, where $S_{min}$ is the minimum value of the scalar quantity for LSDD spectrum 511:

$$L_{sp} = \frac{S_{max} - S_{min}}{\frac{\sum S(\theta_i) - S_{max}}{N} - S_{min}} \tag{2}$$

In some embodiments, selector 377 may compare the computed local spectrum value to a pre-determined threshold. In some embodiments, selector 377 may compare a different value based on the local spectrum value to the pre-determined threshold. For example, selector 377 may compute a confidence value, which reflects the ground-truth direct-to-reverberant ratio (DRR). In some embodiments, the confidence value may be a function of the local spectrum value, similar to a decibel value. The confidence value is illustrated in Equation 3:

$$C = 20 \log_{10}(L_{sp}) \tag{3}$$

In some embodiments, DOA estimation device 300 may store the pre-determined threshold as a quantity, such as 10, requiring a local spectrum value of at least 10 for selector 377 of LSDD selector 307 to select the target TF bin 410 to be transmitted to DOA estimator 309. In some embodiments, upon determining whether to select a TF bin, selector 307 may apply a binary mask to the TF bin my combining the TF bin with a weight value. For example, selector 307 may apply a weight value ($\mu_{X,V}$) of 1 to a selected TF bin, while applying a weight value of zero to a non-selected TF bin.

Figure 6:
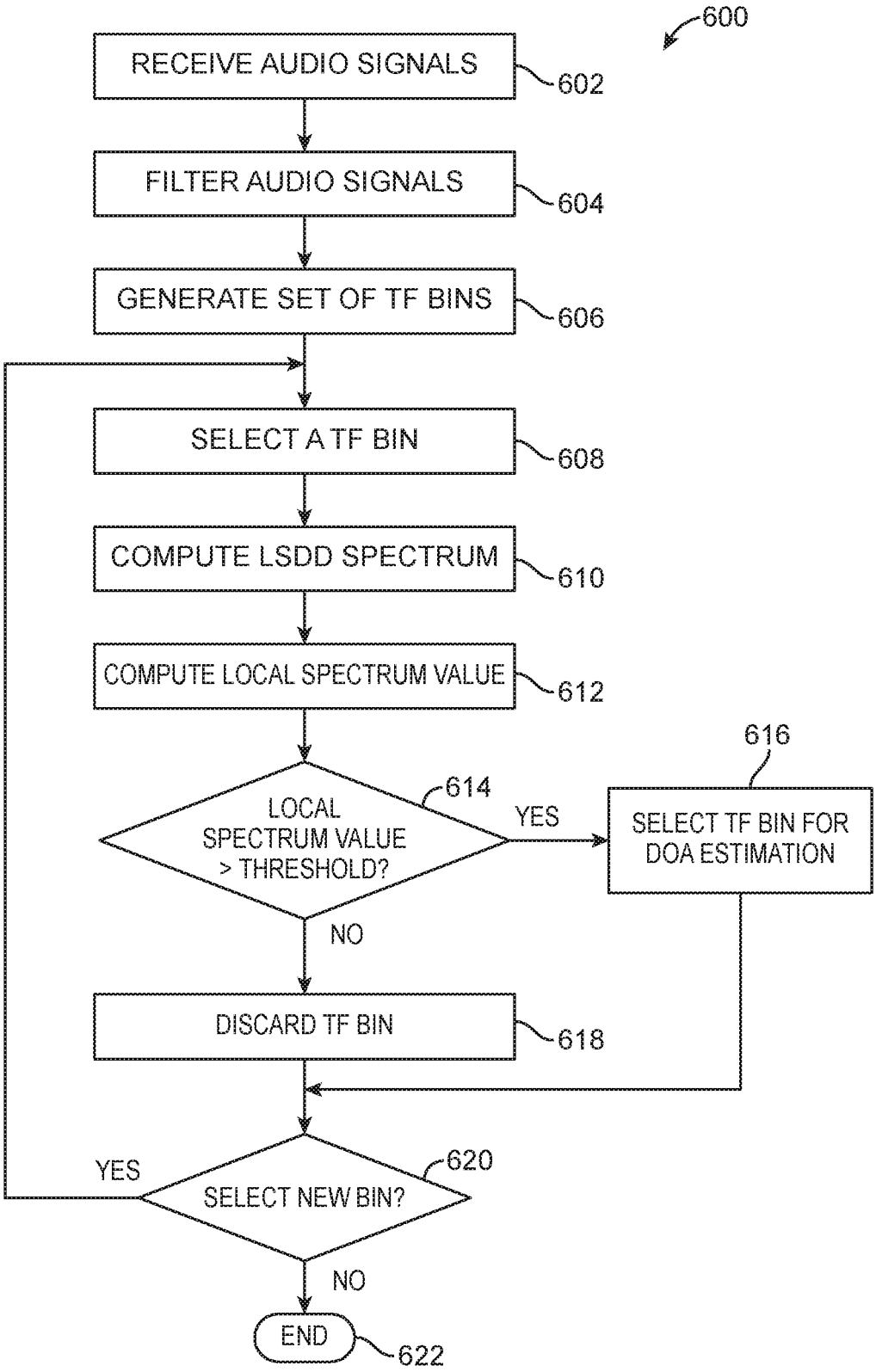
FIG. 6 sets forth a flow diagram of method steps for selecting a TF bin for DOA estimation, according to various embodiments of the disclosure.

FIG. 6 sets forth a flow diagram of method steps for selecting a TF bin for DOA estimation, according to various embodiments of the disclosure. Although the method steps are described with reference to the systems of FIGS. 1-5, persons skilled in the art will understand that the method steps can be performed in any order by any system.

Method 600 begins at steps 602, where DOA estimation device 300 receives an input audio signal. In some embodiments, microphone array 103 of NED 100 may receive multiple acoustic signals as the input audio signal. In some embodiments, microphone array 103 may receive the acoustic signals as a continuous signal. In alternative embodiments, microphone array 103 may receive the acoustic signals as discrete signals. In some embodiments, microphone array 103 receives audio spectrum that includes direct-path acoustic signal 211, reflected-path acoustic signals 213*a-d*, and noise signals 215*a-b*.

At step 604, DOA estimation device 300 may optionally filter the input audio signal. In some embodiments, each parallel path in the front-end of DOA estimation device 300 may include a filter 305*a-d* that receives a digital signal from an analog-to-digital converter 303*a-d*. Each of filters 305*a-d* may filter some of the digital audio received from respective A/D converters 303*a-d* to remove some noise from the signal. In some embodiments, filters 303*a-d* may be a high-pass filter, a low-pass filter, and/or a bandpass filter.

At step 606, DOA estimation device 300 generates a set of TF bins 410. In some embodiments, DOA estimation device 300 may implement M-dimensional STFT 306 to generate an audio spectrum 405 that includes a set of TF bins 410. In some embodiments, each of TF bins 410 includes an equal portion of the frequency range and/or an equal portion of the time frame of the spatial spectrum 405. For example, each of TF bins 410 may include a spatial spectrum within a frequency range of 1000 Hz and a time range of 2 seconds.

At step 608, DOA estimation device 300 selects a given TF bin 410 for processing. In some embodiments, DOA estimation device 300 may implement LSDD selector 307 to successively process each of the set of TF bins 410 generated in step 606 in order to select a set of target TF bins 410 for DOA estimation by DOA estimator 309.

At step 610, DOA estimation device 300 computes a LSDD spectrum 511 for the given TF bin 410. In some embodiments, LSDD spectrum module 375 of LSDD selector 307 may compute a LSDD spectrum 511 within the given TF bin 410 that reflects the amplitude of a signal as a function of the angle at which microphone array 103 received the acoustic signal. In some embodiments, LSDD spectrum module 375 computes LSDD spectrum 511 by computing a LSDD value for each angle included in the given TF bin 410 for a specified frequency.

At step 612, DOA estimation device 300 computes a local spectrum value. In some embodiments, selector 377 of LSDD selector 307 may compute the local spectrum value by first determining the maximum peak 521 of the LSDD spectrum 511, along with a set of secondary peaks 523*a-i* of LSDD spectrum 511. In some embodiments, the local spectrum value is a peak-to-noise ratio reflecting the comparative strength of direct-path acoustic signal 211 to other acoustic signals (e.g., reverberant-path acoustic signals 213*a-d* and/or noise signals 215*a-b*) included in the LSDD spectrum 511 within the given TF bin 410. In some embodiments, DOA estimation device 300 may implement selector 377 to compute the local spectrum value as a ratio of highest peak 521 of the scalar quantity for LSDD spectrum 511 compared to secondary peaks 523*a-i* of the scalar quantity for LSDD spectrum 511.

At step 614, DOA estimation device 300 compares the local spectrum value to a pre-determined threshold. In some embodiments, selector 377 may compare the local spectrum value computed in step 610 and to a pre-determined threshold. In some embodiments, DOA estimation device 300 may store the pre-determined threshold as a quantity, such as 10, requiring a local spectrum value of at least 10 for selector 377 of LSDD selector 307 to select the given TF bin 410 for DOA estimation. When selector 377 determines that the local spectrum value exceeds the pre-determined threshold, DOA estimation device 300 proceeds to step 616; otherwise DOA estimation device 300 proceeds to step 618, where DOA estimation device 300 discards the given TF bin 410.

At step 616, DOA estimation device 300 selects the given TF bin 410 for DOA estimation. In some embodiments, selector 377 of LSDD selector 307 selects the given TF bin 410 for DOA estimation of its LSDD spectrum 511 by DOA estimator 309. In some embodiments, selector 307 may apply a binary mask to the TF bin my combining the TF bin with a weight value. For example, selector 307 may apply a weight value ($\mu_{X,\nu}$) of 1 to a selected TF bin, while applying a weight value of zero to a non-selected TF bin. In some embodiments, LSDD selector 307 may store each of the TF bins 410 selected by LSDD selector 307 for further processing, and then send the set of selected TF bins 410 to DOA estimator 309 for DOA estimation. In some embodiments, LSDD selector 307 sends a selected TF bin 410 and causes DOA estimator 307 to perform the DOA estimation of the selected TF bin 410 in parallel with LSDD selector 307 processing the next given TF bin 410, as described in step 608.

At step 620, DOA estimation device 300 determines whether to select a new given TF bin 410. When DOA estimation device 300 determines that additional TF bins 410 remain for processing, DOA estimation device 300 proceeds to step 608, where DOA estimation device 300 selects one of the remaining TF bins 410 for processing via LSDD spectrum module 306. Otherwise, when DOA estimation device 300 determines that no TF bins 410 remain for further processing, DOA estimation device ends method 600 at step 622.

DOA Estimation Using a Soft Mask

Figure 7:
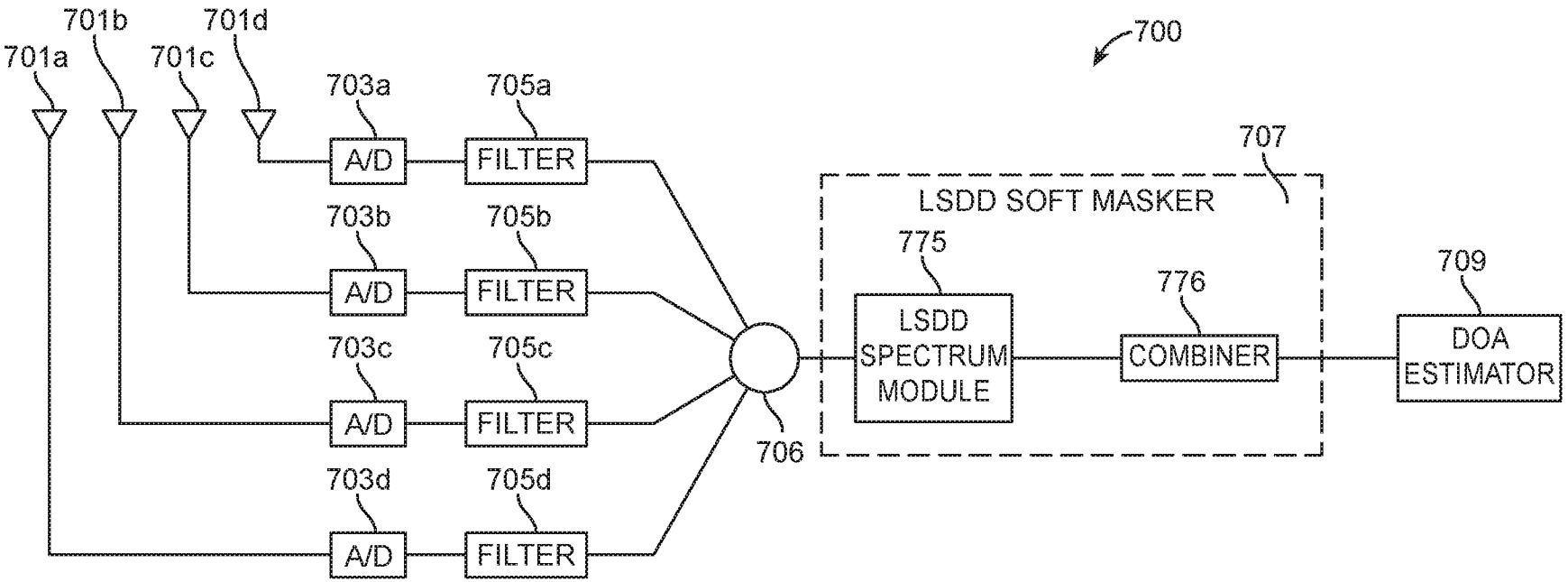
FIG. 7 is a detailed illustration of another DOA estimation device included in the NED of FIG. 1, according to various embodiments of the present disclosure.

FIG. 7 is a detailed illustration of another DOA estimation device included in the NED of FIG. 1, according to various embodiments of the present disclosure. DOA estimation device 700 includes microphones 701*a-d*, analog/digital (ND) converters 703*a-d*, filters 705*a-d*, M-dimensional short-time Fourier transfer (STFT) 706, LSDD soft masker 707, and DOA estimator 709. The LSDD soft masker 707 includes an LSDD spectrum module 775 and selector 777.

DOA estimation device 700 may be a component of NED 100 that receives audio signals and determines the direction of direct-path acoustic signal 211 included in the audio spectrum. In some embodiments, DOA estimation device 700 may include hardware and/or software to process the received set of audio signals to determine, via a soft mask, what part of the received audio signal is the direct-path acoustic signal 211, and also determine the direction of the direct-path acoustic signal 211, as specified by relative angle 220.

The front-end of DOA estimation device 700 includes one or more microphones 701*a-d*, one or more A/D converters 703*a-d*, and one or more filters 705*a-d*. In some embodiments, each of microphones 701*a-d* receives multiple audio signals, including direct-path acoustic signal 211, reflected-path acoustic signals 213*a-d*, and/or noise signals 215*a-b*. A/D converters 703*a-d* convert the audio signal received by the respective microphone 701*a-d* into a digital signal. Each filter 705*a-d* filters some of the digital audio received from respective A/D converters 703*a-d* to remove some noise from the signal. In some embodiments, filters 703*a-d* may be a high-pass filter, a low-pass filter, and/or a bandpass filter. M-dimensional Short-time Fourier transform 706 receives an M-channel signal from filters 705*a-d* and transforms the M-channel signal into the STFT domain. The transform of the M-channel audio signal is the audio spectrum, with each time-frequency (TF) bin included in the audio spectrum represented as audio/complex-valued vectors.

LSDD soft masker 707 included in DOA estimation device 700 performs direct sound selection (DSS). When applying a soft mask to the audio spectrum, DOA estimation device 700 discriminates one or more of the TF bins based on the local spectrum included in each of the TF bins. In operation, LSDD soft masker 707 receives one or more TF bins from M-dimensional STFT 306, processes the one or more TF bins to generate weighted LSDD spectrum values, and generates a combined spectrum value from each of the weighted LSDD spectrum values. Upon generating the combined spectrum value, LSDD soft masker 707 transmits the combined spectrum value to DOA estimator 309 for DOA estimation. When separately processing each of the TF bins included in the audio spectrum, LSDD soft masker 707 determines a weight value to apply to a given TF bin 410 based on the local spectrum value of the TF bin 410. LSDD soft masker 707 then generates a combined spectrum value based on each of the respective local spectrum values and weight values.

LSDD spectrum module 775 within LSDD soft masker 707 computes a LSDD spectrum, DRR metric, and/or weighted LSDD spectrum value for a given TF bin 410. As discussed above, the LSDD spectrum within a given TF bin reflects the amplitude of the spatial spectrum as a function of the angle at which microphone array 103 received the acoustic signal. LSDD spectrum module 775 computes the LSDD spectrum $S_{\tau,\nu}(\theta)$ as a function of the TF bin, $X_{\tau,\nu}$, and the array manifold for the audio signals, $V_\nu$.

LSDD spectrum module 775 generates weight value for a given TF bin based on one or more metrics associated with the local spectrum 511 included in the TF bin 0410. For example, LSDD spectrum module 775 may generate a weight value $\mu_{\tau,\nu}$ as a function of a DRR metric $d_{\tau,\nu}$ for the given TF bin $X_{\tau,\nu}$. The DRR metric reflects the similarity of the LSDD spectrum in the given TF bin to the direct-path acoustic signal 211. In some embodiments, the LSDD spectrum module 775 may compute the weight value as a function of the inverse of the DDR metric and a scaling factor α, as shown in Equation 4:

$$\mu_{\tau,\nu}=(1/d_{\tau,\nu}) \quad (4)$$

In some embodiments, LSDD spectrum module 775 may compute other metrics that determine the relative strength (e.g., concentration) of the direct-path acoustic signal 211 compared to other signals within a given TF bin 410. For example, LSDD spectrum 775 may compute a direct-path distance (DPD) metric, a SH sound-field directivity metric, and/or an estimation consistency metric for the given TF bin 410.

In various embodiments, combiner 776 included in LSDD soft masker 707 applies a soft mask to each TF bin. For a, combiner 776 receives the weight value for the given TF bin 410 and local spectrum value for the given TF bin 410 and computes a weighted LSDD spectrum value for the given TF bin 410. For example, LSDD spectrum module 775 may combine the weight value with the LSDD spectrum value via multiplication to produce the weighted LSDD spectrum value. In various embodiments, combiner 776 computes each weighted LSDD spectrum value separately.

Combiner 776 generates a combined spectrum value by combining two or more of the weighted LSDD spectrum values. For example, in some embodiments, combiner 776 may generate the combined spectrum value by combining the weighted LSDD spectrum values computed for each TF bin 410. The combined spectrum value includes all local spectrum values included in the spatial spectrum, where portions of the combined spectrum value are weighted based on the separately-computed weight values.

DOA estimator 709 implements DOA estimation on the combined spectrum value received from combiner 776. In some embodiments, DOA estimator 709 may compile weighted estimated directions corresponding to the weighted LSDD spectrum values to compute an estimated angle 220. In some embodiments, DOA estimator 709 may transmit estimated angle 220 to a different component of NED 100, which may incorporate estimated angle 220 when implementing an AR application.

Figure 8:
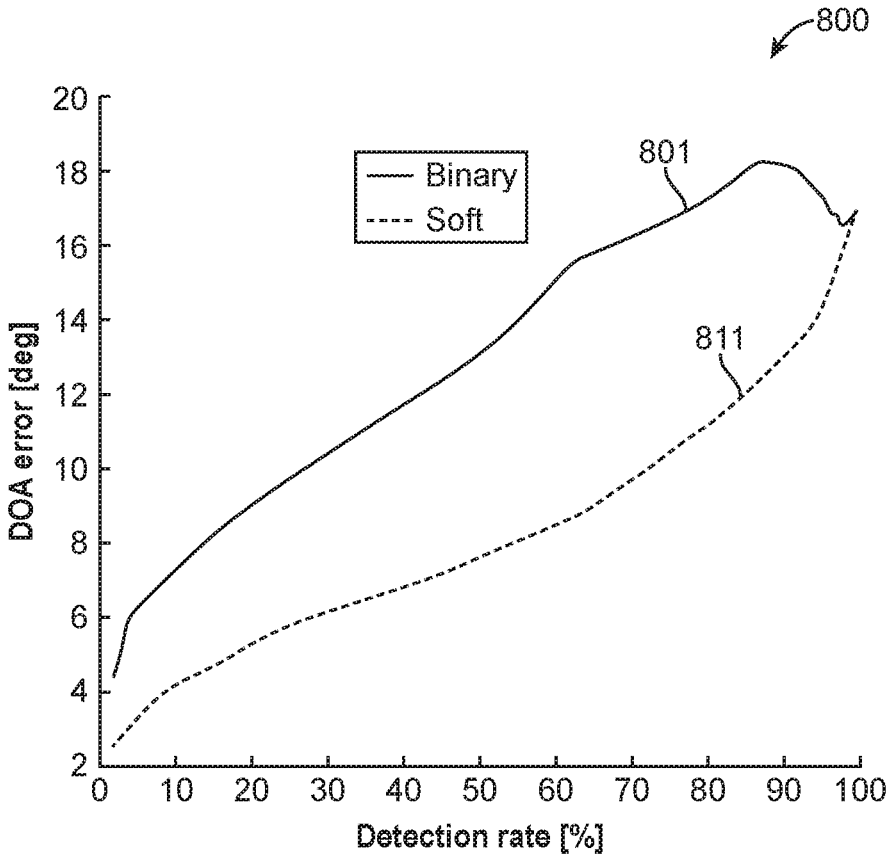
FIG. 8 is an illustration of DOA estimation performance using various masking techniques for direct sound selection, according to various embodiments of the present disclosure.

FIG. 8 is an illustration of DOA estimation performance using various masking techniques for direct sound selection, according to various embodiments of the present disclosure. For example, graph 800 illustrates, for example DOA estimators 300, 700, a computed estimate of error for estimated angle 220. In this example, estimate angle 220 is computed using differing masking techniques on the TF bins 410 included in the audio spectrum. As shown, the error curve 801 for a DOA estimator 300 performing binary masking is higher for most detection rates than the error curve 811 for a DOA estimator 700 performing soft masking.

Figure 9:
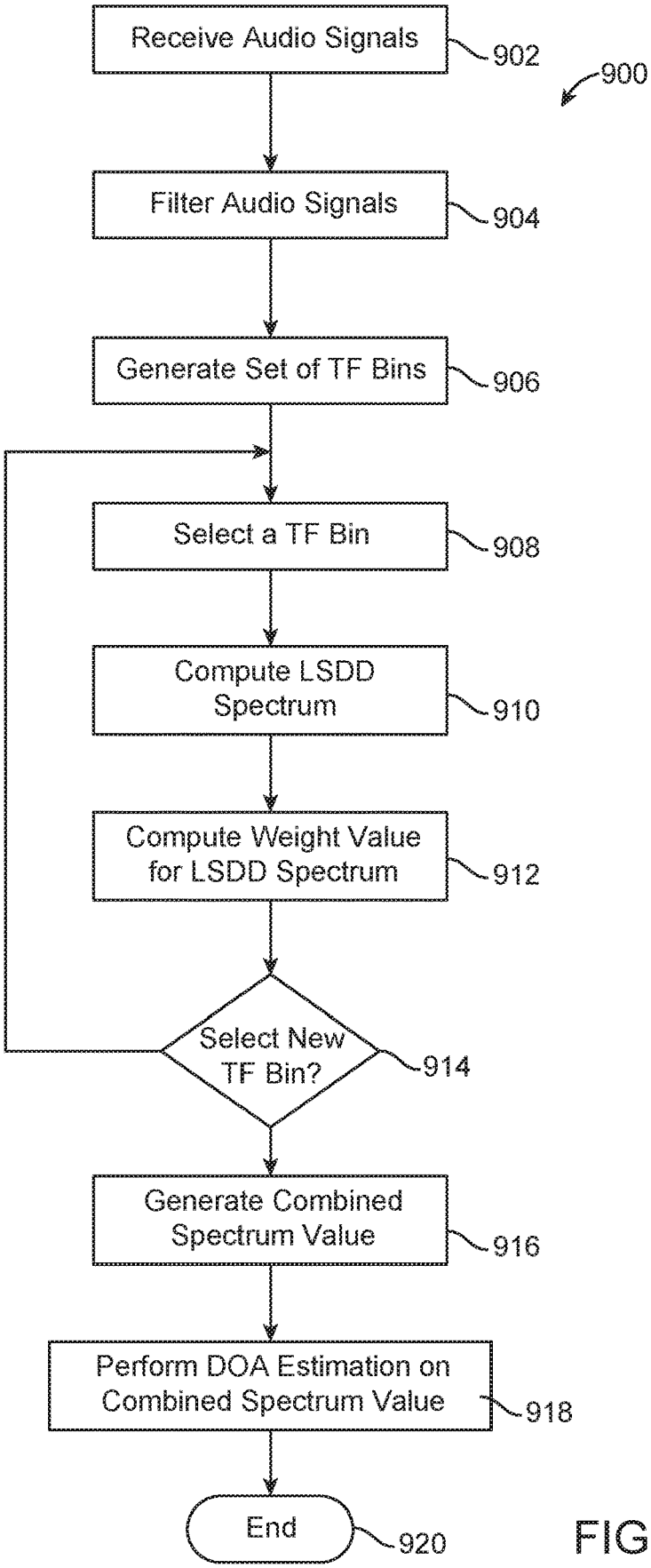
FIG. 9 sets forth a flow diagram of method steps for weighing multiple TF bins for DOA estimation, according to various embodiments of the disclosure.

FIG. 9 sets forth a flow diagram of method steps for weighing multiple TF bins for DOA estimation, according to various embodiments of the disclosure. Although the method steps are described with reference to the systems of FIGS. 1-8, persons skilled in the art will understand that the method steps can be performed in any order by any system.

Method 900 begins at step 902, where DOA estimation device 700 receives an input audio signal. In some embodiments, microphone array 103 of NED 100 may receive multiple acoustic signals as the input audio signal. In some embodiments, microphone array 103 may receive the acoustic signals as a continuous signal. In alternative embodiments, microphone array 103 may receive the acoustic signals as discrete signals. In some embodiments, microphone array 103 receives an audio spectrum that includes direct-path acoustic signal 211, reflected-path acoustic signals 213*a-d*, and noise signals 215*a-b*.

At step 904, DOA estimation device 700 may optionally filter the input audio signal. In some embodiments, each parallel path in the front-end of DOA estimation device 700 may include a filter 705*a-d* that receives a digital signal from an analog-to-digital converter 703*a-d*. Each of filters 705*a-d* may filter some of the digital audio received from respective A/D converters 703*a-d* to remove some noise from the signal. In some embodiments, filters 703*a-d* may be a high-pass filter, a low-pass filter, and/or a bandpass filter.

At step 906, DOA estimation device 700 generates a set of TF bins 410. In some embodiments, DOA estimation device 700 may implement M-dimensional STFT 706 to generate an audio spectrum that includes a set of TF bins 410. In some embodiments, each of TF bins 410 includes an equal portion of the frequency range and/or an equal portion of the time frame of spatial spectrum 405. For example, each of TF bins 410 may include a spatial spectrum within a frequency range of 800 Hz and a time range of 5 seconds.

At step 908, DOA estimation device 700 selects a given TF bin 410 for processing. In some embodiments, DOA estimation device 700 may implement LSDD soft masker 707 to successively process each of the set of TF bins 410 generated in step 906 in order to successively weigh each of the set of TF bins 410 in order for DOA estimator 309 to perform DOA estimation on the combined spectrum value.

At step 910, DOA estimation device 700 computes a LSDD spectrum 511 for the given TF bin 410. In some embodiments, LSDD spectrum module 775 of LSDD soft masker 707 may compute LSDD spectrum 511 within the given TF bin 410 that reflects the amplitude of a signal as a function of the angle at which microphone array 103 received the acoustic signal. In some embodiments, LSDD spectrum module 775 computes LSDD spectrum 511 by computing a LSDD value for each angle included in the given TF bin 410 for a specified frequency.

At step 912, DOA estimation device 700 computes a weight value for the LSDD spectrum 511. LSDD spectrum module 775 computes a weight value for the given TF bin based on the local spectrum value of LSDD spectrum 511. When computing the weight value, LSDD spectrum module 775 computes the local spectrum value by determining the maximum peak 521 of the LSDD spectrum 511, along with a set of secondary peaks 523*a-i* of LSDD spectrum 511. In some embodiments, the local spectrum value is a peak-to-noise ratio reflecting the comparative strength of direct-path acoustic signal 211 to other acoustic signals (e.g., reverberant-path acoustic signals 213*a-d* and/or noise signals 215*a-b*) included in the LSDD spectrum 511 within the given TF bin 410. LSDD spectrum module 775 computes the weight value as a function of the local spectrum value. In some embodiments, LSDD spectrum module 775 may compute the weight value as a function of specific metric, such as a direct-to-reverberant ratio (DRR) metric that itself is a function of the local spectrum value. For example, LSDD spectrum module 775 can compute a weight value that is an inverse of the DRR metric.

At step 914, DOA estimation device 700 determines whether to select a new TF bin 410 for computation. If any TF bins remain DOA estimation 700 returns to step 908 to select the new TF bin. Otherwise, upon determining that all the TF bins have been computed, DOA estimation device 700 proceeds to step 916.

At step 916, DOA estimation device 700 generates a combined spectrum value. In some embodiments, combiner 776 of LSDD soft masker 776 may combine local spectrum values of two or more TF bins 410. In various embodiments, combiner 776 first applies a soft mask to each of the local spectrum values by applying the corresponding weight value computed for the given local spectrum value. For example, in some embodiments, combiner 776 may receive the local spectrum value and the weight value ($\mu_{X,V}$) for a given TF bin 410. Combiner 776 may combine the local spectrum value with the weight value to generate a weighted LSDD spectrum value.

In various embodiments, combiner 776 may combine two or more weighted LSDD spectrum values to generate the combined spectrum value. For example, in some embodiments, combiner 776 may generate the combined spectrum value by combining the weighted LSDD spectrum values from each TF bin generated at step 906. The combined spectrum value includes all local spectrum values included in the spatial spectrum.

At step 918, DOA estimation device 700 performs DOA estimation on the combined spectrum value to determine an estimated angle 200 of the audio source. In some embodiments, DOA estimator 709 receives the combined spectrum value from LSDD soft masker 707 and estimates the direction based on one or more local spectrum values included in the combined spectrum value to compute an estimated angle 220.

The Artificial Reality System

Figure 10:
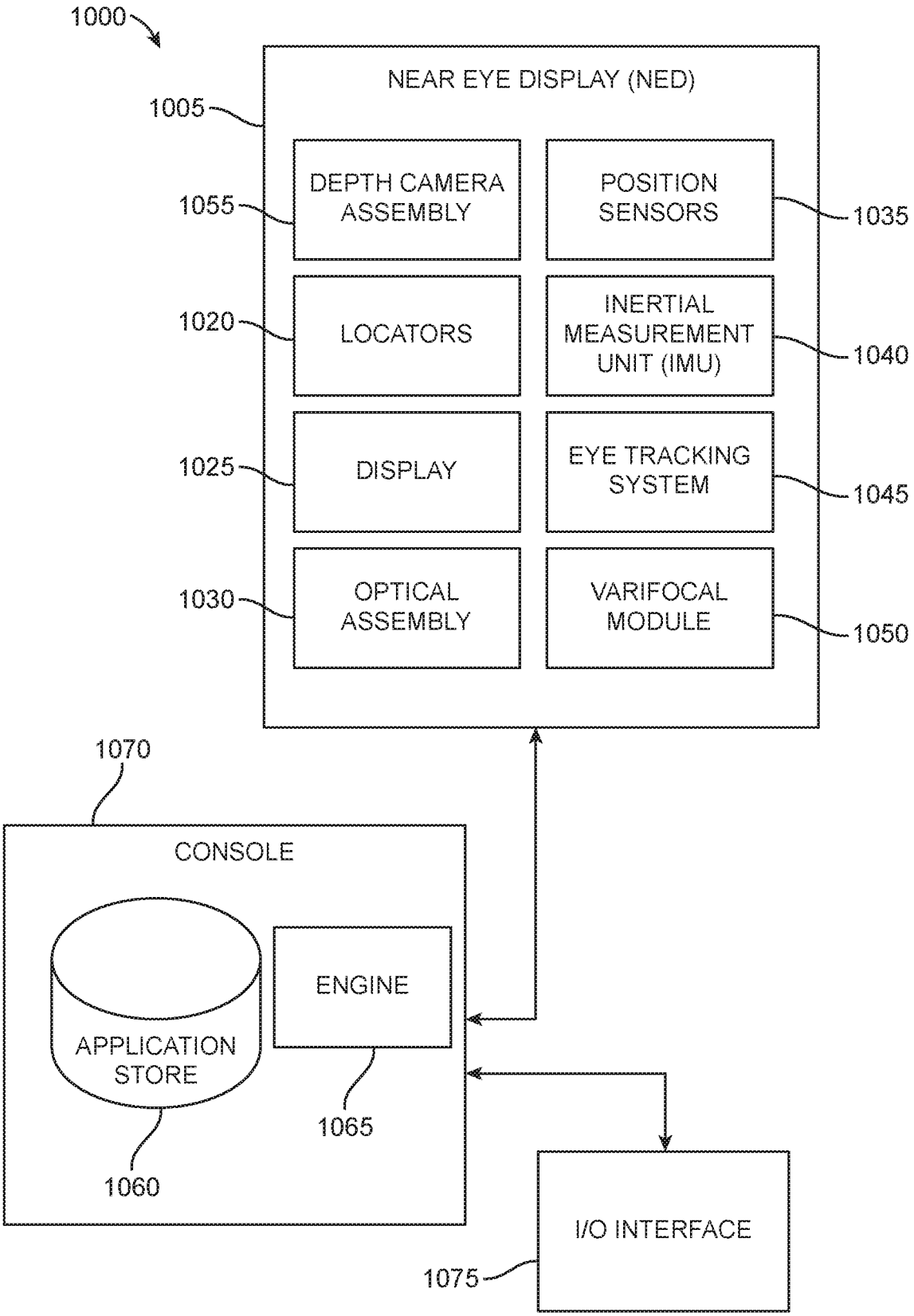
FIG. 10 is a block diagram of an embodiment of a near-eye display (NED) system in which a console operates, according to various embodiments.

FIG. 10 is a block diagram of an embodiment of a near-eye display (NED) system in which a console 1070 operates, according to various embodiments. The NED system 1000 may operate in a virtual reality (VR) system environment, an augmented reality (AR) system environment, a mixed reality (MR) system environment, or some combination thereof. The NED system 1000 shown in FIG. 10 comprises a NED 1005 and an input/output (I/O) interface 1075 that is coupled to the console 1070. In various embodiments, the audio system 105 is included in or operates in conjunction with the NED system 1000. For example, the audio system 105 may be included within NED 1005 or may be coupled to the console 1070 and/or the NED 1005. Further, the application 140 may execute on the console 1070 or within the NED 1005.

While FIG. 10 shows an example NED system 1000 including one NED 1005 and one I/O interface 1075, in other embodiments any number of these components may be included in the NED system 1000. For example, there may be multiple NEDs 1005, and each NED 1005 has an associated I/O interface 1075. Each NED 1005 and I/O interface 1075 communicates with the console 1070. In alternative configurations, different and/or additional components may be included in the NED system 1000. Additionally, various components included within the NED 1005, the console 1070, and the I/O interface 1075 may be distributed in a different manner than is described in conjunction with FIGS. 1-9 in some embodiments. For example, some or all of the functionality of the console 1070 may be provided by the NED 1005, and vice versa.

The NED 1005 may be a head-mounted display that presents content to a user. The content may include virtual and/or augmented views of a physical, real-world environment including computer-generated elements (e.g., two-dimensional or three-dimensional images, two-dimensional or three-dimensional video, sound, etc.). In some embodiments, the NED 1005 may also present audio content to a user. The NED 1005 and/or the console 1070 may transmit the audio content to an external device via the I/O interface 1075. The external device may include various forms of speaker systems and/or headphones. In various embodiments, the audio content is synchronized with visual content being displayed by the NED 1005.

The NED 1005 may comprise one or more rigid bodies, which may be rigidly or non-rigidly coupled together. A rigid coupling between rigid bodies causes the coupled rigid bodies to act as a single rigid entity. In contrast, a non-rigid coupling between rigid bodies allows the rigid bodies to move relative to each other.

As shown in FIG. 10, the NED 1005 may include a depth camera assembly (DCA) 1055, one or more locators 1020, a display 1025, an optical assembly 1030, one or more position sensors 1035, an inertial measurement unit (IMU) 1040, an eye tracking system 1045, and a varifocal module 1050. In some embodiments, the display 1025 and the optical assembly 1030 can be integrated together into a projection assembly. Various embodiments of the NED 1005 may have additional, fewer, or different components than those listed above. Additionally, the functionality of each component may be partially or completely encompassed by the functionality of one or more other components in various embodiments.

The DCA 1055 captures sensor data describing depth information of an area surrounding the NED 1005. The sensor data may be generated by one or a combination of depth imaging techniques, such as triangulation, structured light imaging, time-of-flight imaging, stereo imaging, laser scan, and so forth. The DCA 1055 can compute various depth properties of the area surrounding the NED 1005 using the sensor data. Additionally or alternatively, the DCA 1055 may transmit the sensor data to the console 1070 for processing. Further, in various embodiments, the DCA 1055 captures or samples sensor data at different times. For example, the DCA 1055 could sample sensor data at different times within a time window to obtain sensor data along a time dimension.

The DCA 1055 includes an illumination source, an imaging device, and a controller. The illumination source emits light onto an area surrounding the NED 1005. In an embodiment, the emitted light is structured light. The illumination source includes a plurality of emitters that each emits light having certain characteristics (e.g., wavelength, polarization, coherence, temporal behavior, etc.). The characteristics may be the same or different between emitters, and the emitters can be operated simultaneously or individually. In one embodiment, the plurality of emitters could be, e.g., laser diodes (such as edge emitters), inorganic or organic light-emitting diodes (LEDs), a vertical-cavity surface-emitting laser (VCSEL), or some other source. In some embodiments, a single emitter or a plurality of emitters in the illumination source can emit light having a structured light pattern. The imaging device captures ambient light in the environment surrounding NED 1005, in addition to light reflected off of objects in the environment that is generated by the plurality of emitters. In various embodiments, the imaging device may be an infrared camera or a camera configured to operate in a visible spectrum. The controller coordinates how the illumination source emits light and how the imaging device captures light. For example, the controller may determine a brightness of the emitted light. In some embodiments, the controller also analyzes detected light to detect objects in the environment and position information related to those objects.

The locators 1020 are objects located in specific positions on the NED 1005 relative to one another and relative to a specific reference point on the NED 1005. A locator 1020 may be a light emitting diode (LED), a corner cube reflector, a reflective marker, a type of light source that contrasts with an environment in which the NED 1005 operates, or some combination thereof. In embodiments where the locators 1020 are active (i.e., an LED or other type of light emitting device), the locators 1020 may emit light in the visible band (~380 nm to 950 nm), in the infrared (IR) band (~950 nm to 9700 nm), in the ultraviolet band (70 nm to 380 nm), some other portion of the electromagnetic spectrum, or some combination thereof.

In some embodiments, the locators 1020 are located beneath an outer surface of the NED 1005, which is transparent to the wavelengths of light emitted or reflected by the locators 1020 or is thin enough not to substantially attenuate the wavelengths of light emitted or reflected by the locators 1020. Additionally, in some embodiments, the outer surface or other portions of the NED 1005 are opaque in the visible band of wavelengths of light. Thus, the locators 1020 may emit light in the IR band under an outer surface that is transparent in the IR band but opaque in the visible band.

The display 1025 displays two-dimensional or three-dimensional images to the user in accordance with pixel data received from the console 1070 and/or one or more other sources. In various embodiments, the display 1025 comprises a single display or multiple displays (e.g., separate displays for each eye of a user). In some embodiments, the display 1025 comprises a single or multiple waveguide displays. Light can be coupled into the single or multiple waveguide displays via, e.g., a liquid crystal display (LCD), an organic light emitting diode (OLED) display, an inorganic light emitting diode (ILED) display, an active-matrix organic light-emitting diode (AMOLED) display, a transparent organic light emitting diode (TOLED) display, a laser-based display, one or more waveguides, other types of displays, a scanner, a one-dimensional array, and so forth. In addition, combinations of the displays types may be incorporated in display 1025 and used separately, in parallel, and/or in combination.

The optical assembly 1030 magnifies image light received from the display 1025, corrects optical errors associated with the image light, and presents the corrected image light to a user of the NED 1005. The optical assembly 1030 includes a plurality of optical elements. For example, one or more of the following optical elements may be included in the optical assembly 1030: an aperture, a Fresnel lens, a convex lens, a concave lens, a filter, a reflecting surface, or any other suitable optical element that deflects, reflects, refracts, and/or in some way alters image light. Moreover, the optical assembly 1030 may include combinations of different optical elements. In some embodiments, one or more of the optical elements in the optical assembly 1030 may have one or more coatings, such as partially reflective or antireflective coatings.

In some embodiments, the optical assembly 1030 may be designed to correct one or more types of optical errors. Examples of optical errors include barrel or pincushion distortions, longitudinal chromatic aberrations, or transverse chromatic aberrations. Other types of optical errors may further include spherical aberrations, chromatic aberrations or errors due to the lens field curvature, astigmatisms, in addition to other types of optical errors. In some embodiments, visual content transmitted to the display 1025 is pre-distorted, and the optical assembly 1030 corrects the distortion as image light from the display 1025 passes through various optical elements of the optical assembly 1030. In some embodiments, optical elements of the optical assembly 1030 are integrated into the display 1025 as a projection assembly that includes at least one waveguide coupled with one or more optical elements.

The IMU 1040 is an electronic device that generates data indicating a position of the NED 1005 based on measurement signals received from one or more of the position sensors 1035 and from depth information received from the DCA 1055. In some embodiments of the NED 1005, the IMU 1040 may be a dedicated hardware component. In other embodiments, the IMU 1040 may be a software component implemented in one or more processors.

In operation, a position sensor 1035 generates one or more measurement signals in response to a motion of the NED 1005. Examples of position sensors 1035 include: one or more accelerometers, one or more gyroscopes, one or more magnetometers, one or more altimeters, one or more inclinometers, and/or various types of sensors for motion detection, drift detection, and/or error detection. The position sensors 1035 may be located external to the IMU 1040, internal to the IMU 1040, or some combination thereof.

Based on the one or more measurement signals from one or more position sensors 1035, the IMU 1040 generates data indicating an estimated current position of the NED 1005 relative to an initial position of the NED 1005. For example, the position sensors 1035 include multiple accelerometers to measure translational motion (forward/back, up/down, left/right) and multiple gyroscopes to measure rotational motion (e.g., pitch, yaw, and roll). In some embodiments, the IMU 1040 rapidly samples the measurement signals and calculates the estimated current position of the NED 1005 from the sampled data. For example, the IMU 1040 integrates the measurement signals received from the accelerometers over time to estimate a velocity vector and integrates the velocity vector over time to determine an estimated current position of a reference point on the NED 1005. Alternatively, the IMU 1040 provides the sampled measurement signals to the console 1070, which analyzes the sample data to determine one or more measurement errors. The console 1070 may further transmit one or more of control signals and/or measurement errors to the IMU 1040 to configure the IMU 1040 to correct and/or reduce one or more measurement errors (e.g., drift errors). The reference point is a point that may be used to describe the position of the NED 1005. The reference point may generally be defined as a point in space or a position related to a position and/or orientation of the NED 1005.

In various embodiments, the IMU 1040 receives one or more parameters from the console 1070. The one or more parameters are used to maintain tracking of the NED 1005. Based on a received parameter, the IMU 1040 may adjust one or more IMU parameters (e.g., a sample rate). In some embodiments, certain parameters cause the IMU 1040 to update an initial position of the reference point so that it corresponds to a next position of the reference point. Updating the initial position of the reference point as the next calibrated position of the reference point helps reduce drift errors in detecting a current position estimate of the IMU 1040.

In various embodiments, the eye tracking system 1045 is integrated into the NED 1005. The eye-tracking system 1045 may comprise one or more illumination sources (e.g., infrared illumination source, visible light illumination source) and one or more imaging devices (e.g., one or more cameras). In operation, the eye tracking system 1045 generates and analyzes tracking data related to a user's eyes as the user wears the NED 1005. In various embodiments, the eye tracking system 1045 estimates the angular orientation of the user's eye. The orientation of the eye corresponds to the direction of the user's gaze within the NED 1005. The orientation of the user's eye is defined herein as the direction of the foveal axis, which is the axis between the fovea (an area on the retina of the eye with the highest concentration of photoreceptors) and the center of the eye's pupil. In general, when a user's eyes are fixed on a point, the foveal axes of the user's eyes intersect that point. The pupillary axis is another axis of the eye that is defined as the axis passing through the center of the pupil and that is perpendicular to the corneal surface. The pupillary axis does not, in general, directly align with the foveal axis. Both axes intersect at the center of the pupil, but the orientation of the foveal axis is offset from the pupillary axis by approximately −1° to 8° laterally and ±4° vertically. Because the foveal axis is defined according to the fovea, which is located in the back of the eye, the foveal axis can be difficult or impossible to detect directly in some eye tracking embodiments. Accordingly, in some embodiments, the orientation of the pupillary axis is detected and the foveal axis is estimated based on the detected pupillary axis.

In general, movement of an eye corresponds not only to an angular rotation of the eye, but also to a translation of the eye, a change in the torsion of the eye, and/or a change in shape of the eye. The eye tracking system 1045 may also detect translation of the eye, i.e., a change in the position of the eye relative to the eye socket. In some embodiments, the translation of the eye is not detected directly, but is approximated based on a mapping from a detected angular orientation. Translation of the eye corresponding to a change in the eye's position relative to the detection components of the eye tracking unit may also be detected. Translation of this type may occur, for example, due to a shift in the position of the NED 1005 on a user's head. The eye tracking system 1045 may also detect the torsion of the eye, i.e., rotation of the eye about the pupillary axis. The eye tracking system 1045 may use the detected torsion of the eye to estimate the orientation of the foveal axis from the pupillary axis. The eye tracking system 1045 may also track a change in the shape of the eye, which may be approximated as a skew or scaling linear transform or a twisting distortion (e.g., due to torsional deformation). The eye tracking system 1045 may estimate the foveal axis based on some combination of the angular orientation of the pupillary axis, the translation of the eye, the torsion of the eye, and the current shape of the eye.

As the orientation may be determined for both eyes of the user, the eye tracking system 1045 is able to determine where the user is looking. The NED 1005 can use the orientation of the eye to, e.g., determine an inter-pupillary distance (IPD) of the user, determine gaze direction, introduce depth cues (e.g., blur image outside of the user's main line of sight), collect heuristics on the user interaction in the VR media (e.g., time spent on any particular subject, object, or frame as a function of exposed stimuli), some other function that is based in part on the orientation of at least one of the user's eyes, or some combination thereof. Determining a direction of a user's gaze may include determining a point of convergence based on the determined orientations of the user's left and right eyes. A point of convergence may be the point that the two foveal axes of the user's eyes intersect (or the nearest point between the two axes). The direction of the user's gaze may be the direction of a line through the point of convergence and though the point halfway between the pupils of the user's eyes.

In some embodiments, the varifocal module 1050 is integrated into the NED 1005. The varifocal module 1050 may be communicatively coupled to the eye tracking system 1045 in order to enable the varifocal module 1050 to receive eye tracking information from the eye tracking system 1045. The varifocal module 1050 may further modify the focus of image light emitted from the display 1025 based on the eye tracking information received from the eye tracking system 1045. Accordingly, the varifocal module 1050 can reduce vergence-accommodation conflict that may be produced as the user's eyes resolve the image light. In various embodiments, the varifocal module 1050 can be interfaced (e.g., either mechanically or electrically) with at least one optical element of the optical assembly 1030.

In operation, the varifocal module 1050 may adjust the position and/or orientation of one or more optical elements in the optical assembly 1030 in order to adjust the focus of image light propagating through the optical assembly 1030. In various embodiments, the varifocal module 1050 may use eye tracking information obtained from the eye tracking system 1045 to determine how to adjust one or more optical elements in the optical assembly 1030. In some embodiments, the varifocal module 1050 may perform foveated rendering of the image light based on the eye tracking information obtained from the eye tracking system 1045 in order to adjust the resolution of the image light emitted by the display 1025. In this case, the varifocal module 1050 configures the display 1025 to display a high pixel density in a foveal region of the user's eye-gaze and a low pixel density in other regions of the user's eye-gaze.

The I/O interface 1075 facilitates the transfer of action requests from a user to the console 1070. In addition, the I/O interface 1075 facilitates the transfer of device feedback from the console 1070 to the user. An action request is a request to perform a particular action. For example, an action request may be an instruction to start or end capture of image or video data or an instruction to perform a particular action within an application, such as pausing video playback, increasing or decreasing the volume of audio playback, and so forth. In various embodiments, the I/O interface 1075 may include one or more input devices. Example input devices include: a keyboard, a mouse, a game controller, a joystick, and/or any other suitable device for receiving action requests and communicating the action requests to the console 1070. In some embodiments, the I/O interface 1075 includes an IMU 1040 that captures calibration data indicating an estimated current position of the I/O interface 1075 relative to an initial position of the I/O interface 1075.

In operation, the I/O interface 1075 receives action requests from the user and transmits those action requests to the console 1070. Responsive to receiving the action request, the console 1070 performs a corresponding action. For example, responsive to receiving an action request, console 1070 may configure I/O interface 1075 to emit haptic feedback onto an arm of the user. For example, console 1075 may configure I/O interface 1075 to deliver haptic feedback to a user when an action request is received. Additionally or alternatively, the console 1070 may configure the I/O interface 1075 to generate haptic feedback when the console 1070 performs an action, responsive to receiving an action request.

The console 1070 provides content to the NED 1005 for processing in accordance with information received from one or more of: the DCA 1055, the eye tracking system 1045, one or more other components of the NED 1005, and the I/O interface 1075. In the embodiment shown in FIG. 10, the console 1070 includes an application store 1060 and an engine 1065. In some embodiments, the console 1070 may have additional, fewer, or different modules and/or components than those described in conjunction with FIG. 10. Similarly, the functions further described below may be distributed among components of the console 1070 in a different manner than described in conjunction with FIG. 10.

The application store 1060 stores one or more applications for execution by the console 1070. An application is a group of instructions that, when executed by a processor, performs a particular set of functions, such as generating content for presentation to the user. For example, an application may generate content in response to receiving inputs from a user (e.g., via movement of the NED 1005 as the user moves his/her head, via the I/O interface 1075, etc.). Examples of applications include: gaming applications, conferencing applications, video playback applications, or other suitable applications.

In some embodiments, the engine 1065 generates a three-dimensional mapping of the area surrounding the NED 1005 (i.e., the "local area") based on information received from the NED 1005. In some embodiments, the engine 1065 determines depth information for the three-dimensional mapping of the local area based on depth data received from the NED 1005. In various embodiments, the engine 1065 uses depth data received from the NED 1005 to update a model of the local area and to generate and/or modify media content based in part on the updated model of the local area.

The engine 1065 also executes applications within the NED system 1000 and receives position information, acceleration information, velocity information, predicted future positions, or some combination thereof, of the NED 1005. Based on the received information, the engine 1065 determines various forms of media content to transmit to the NED 1005 for presentation to the user. For example, if the received information indicates that the user has looked to the left, the engine 1065 generates media content for the NED 1005 that mirrors the user's movement in a virtual environment or in an environment augmenting the local area with additional media content. Accordingly, the engine 1065 may generate and/or modify media content (e.g., visual and/or audio content) for presentation to the user. The engine 1065 may further transmit the media content to the NED 1005. Additionally, in response to receiving an action request from the I/O interface 1075, the engine 1065 may perform an action within an application executing on the console 1070. The engine 1065 may further provide feedback when the action is performed. For example, the engine 1065 may configure the NED 1005 to generate visual and/or audio feedback and/or the I/O interface 1075 to generate haptic feedback to the user.

In some embodiments, based on the eye tracking information (e.g., orientation of the user's eye) received from the eye tracking system 1045, the engine 1065 determines a resolution of the media content provided to the NED 1005 for presentation to the user on the display 1025. The engine 1065 may adjust a resolution of the visual content provided to the NED 1005 by configuring the display 1025 to perform foveated rendering of the visual content, based at least in part on a direction of the user's gaze received from the eye tracking system 1045. The engine 1065 provides the content to the NED 1005 having a high resolution on the display 1025 in a foveal region of the user's gaze and a low resolution in other regions, thereby reducing the power consumption of the NED 1005. In addition, using foveated rendering reduces a number of computing cycles used in rendering visual content without compromising the quality of the user's visual experience. In some embodiments, the engine 1065 can further use the eye tracking information to adjust a focus of the image light emitted from the display 1025 in order to reduce vergence-accommodation conflicts.

Figure 11:
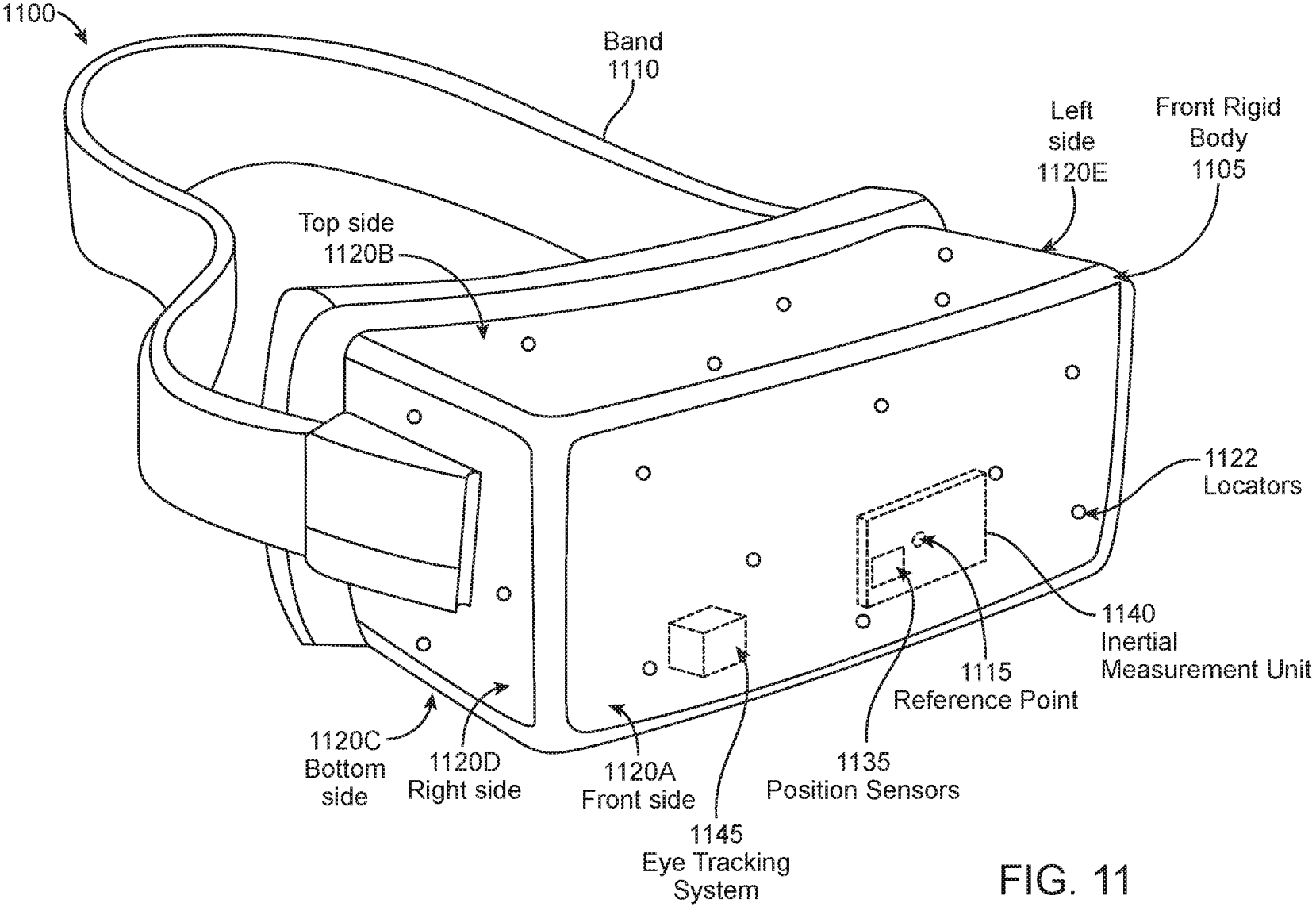
FIG. 11 is another diagram of an NED, according to various embodiments.

FIG. 11 is another diagram of an NED, according to various embodiments. In various embodiments, NED 1100 presents media to a user. The media may include visual, auditory, and haptic content. In some embodiments, NED 1100 provides artificial reality (e.g., virtual reality) content by providing a real-world environment and/or computer-generated content. In some embodiments, the computer-generated content may include visual, auditory, and haptic information. The NED 1100 is an embodiment of the NED 1005 and includes a front rigid body 1105 and a band 1110. The front rigid body 1105 includes an electronic display element of the electronic display 1025 (not shown in FIG. 11), the optics assembly 1030 (not shown in FIG. 11), the IMU 1040, the one or more position sensors 1035, the eye tracking system 1045, and the locators 1020. In the embodiment shown by FIG. 11, the position sensors 1035 are located within the IMU 1040, and neither the IMU 1040 nor the position sensors 1035 are visible to the user.

The locators 1020 are located in fixed positions on the front rigid body 1105 relative to one another and relative to a reference point 1015. In the example of FIG. 11, the reference point 1015 is located at the center of the IMU 1040. Each of the locators 1020 emits light that is detectable by the imaging device in the DCA 1055. The locators 1020, or portions of the locators 1020, are located on a front side 1120A, a top side 1120B, a bottom side 1120C, a right side 1120D, and a left side 1120E of the front rigid body 1105 in the example of FIG. 11.

The NED 1100 includes the eye tracking system 1045. As discussed above, the eye tracking system 1045 may include a structured light generator that projects an interferometric structured light pattern onto the user's eye and a camera to detect the illuminated portion of the eye. The structured light generator and the camera may be located off the axis of the user's gaze. In various embodiments, the eye tracking system 1045 may include, additionally or alternatively, one or more time-of-flight sensors and/or one or more stereo depth sensors. In FIG. 11, the eye tracking system 1045 is located below the axis of the user's gaze, although the eye tracking system 1045 can alternately be placed elsewhere. Also, in some embodiments, there is at least one eye tracking unit for the left eye of the user and at least one tracking unit for the right eye of the user.

In various embodiments, the eye tracking system 1045 includes one or more cameras on the inside of the NED 1100. The camera(s) of the eye tracking system 1045 may be directed inwards, toward one or both eyes of the user while the user is wearing the NED 1100, so that the camera(s) may image the eye(s) and eye region(s) of the user wearing the NED 1100. The camera(s) may be located off the axis of the user's gaze. In some embodiments, the eye tracking system 1045 includes separate cameras for the left eye and the right eye (e.g., one or more cameras directed toward the left eye of the user and, separately, one or more cameras directed toward the right eye of the user).

In sum, embodiments of the present disclosure are directed towards a virtual reality near eye device that includes a direction-of-arrival estimation device for estimating a direction of an acoustic signal. The NED includes a microphone array that receives multiple acoustic signals in an environment. The acoustic signals include a direct-path acoustic signal and one or more reverberant-path acoustic signals. An STFT receives the acoustic signals from the microphone array and transforms the acoustic signals into an audio spectrum. The local-space domain distance (LSDD) soft masker processes each time-frequency (TF) bin included in the audio spectrum and applies a soft mask a given TF bin based on the portion of the audio spectrum included in the given TF bin. An LSDD spectrum module calculates the LSDD spectrum as a function of angles at which the microphone array received acoustic signals. A combiner in the LSDD soft masker applies a weight value to a local spectrum value for the LSDD spectrum. The combiner then combines multiple weighted LSDD values to generate a combined spectrum value. A DOA estimator performs DOA estimation on the combined spectrum value to estimate a direction of the audio source.

At least one advantage of the disclosed embodiments is that the LSDD soft masker weighs different portions of an acoustic spectrum, effectively determining a direction of an acoustic source without discarding relevant information. The LSDD soft masker applies a soft mask by applying a larger weight value to time-frequency bins that contain dominant direct-path signals. The LSDD soft masker effectively focuses on specific portions of the acoustic spectrum to determine the direction of an audio source without requiring computationally-intensive signal processing techniques, or losing information via a binary masking technique. By computing the local space-domain distance for each TF bin individually, the DOA estimation device enables a NED to perform DOA estimation in a computationally-efficient manner, while maintaining accuracy. The LSDD soft masker within the DOA estimation device performs such DOA estimation techniques without requiring a spherical harmonics (SH) framework or a spherical array.

1. In some embodiments, a computer-implemented method comprises receiving, from a first microphone, a first input acoustic signal, generating a first audio spectrum from at least the first input acoustic signal, where the first audio spectrum includes a set of time-frequency bins, for each time-frequency bin included in the set of time-frequency bins, computing a weighted local space-domain distance (LSDD) spectrum value based on a portion of the first audio spectrum that is included in the time-frequency bin, generating a combined spectrum value based on a set of the weighted LSDD spectrum values computed for the set of time-frequency bins, and determining a first estimated direction of the first input acoustic signal based on the combined spectrum value.

2. The computer implemented method of clause 1, where computing the weighted LSDD spectrum value comprises computing an LSDD spectrum value based on the portion of the first audio spectrum, computing a weight value associated with the portion of the first audio spectrum, and combining the local spectrum value with the weight value to generate the weighted LSDD spectrum value.

3. The computer-implemented method of clause 1 or 2, where computing the weight value comprises computing a first metric associated with the portion of the first audio spectrum, and computing a weight value based on the first metric and the LSDD spectrum value.

4. The computer-implemented method of any of clauses 1-3, where the first metric comprises a direct-to-reverberant ratio (DRR) metric that is based on a ratio of a maximum peak value of the LSDD spectrum value relative to an average peak value of the LSDD spectrum value.

5. The computer-implemented method of any of clauses 1-4, wherein the weight value is based on an inverse of the DRR metric.

6. The computer-implemented method of any of clauses 1-5, where generating the first audio spectrum from the first input acoustic signal comprises generating a short-time Fourier transform (STFT) from the first input acoustic signal.

7. The computer-implemented method of any of clauses 1-6, where the microphone is included in a wearable headset.

8. In some embodiments, one or more non-transitory computer-readable storage media includes instructions that, when executed by one or more processors, cause the one or more processors to perform the steps of receiving, from a first microphone, a first input acoustic signal, generating a first audio spectrum from at least the first input acoustic signal, where the first audio spectrum includes a set of time-frequency bins, for each time-frequency bin included in the set of time-frequency bins, computing a weighted local space-domain distance (LSDD) spectrum value based on a portion of the first audio spectrum that is included in the time-frequency bin, generating a combined spectrum value based on a set of the weighted LSDD spectrum values computed for the set of time-frequency bins, and determining a first estimated direction of the first input acoustic signal based on the combined spectrum value.

9. The non-transitory computer-readable storage media of clause 8, where computing the weighted LSDD spectrum value comprises computing an LSDD spectrum value based on the portion of the first audio spectrum, computing a weight value associated with the portion of the first audio spectrum, and combining the local spectrum value with the weight value to generate the weighted LSDD spectrum value.

10. The non-transitory computer-readable storage media of clauses 8 or 9, where computing the weight value comprises computing a first metric associated with the portion of the first audio spectrum, and computing a weight value based on the first metric and the LSDD spectrum value.

11. The non-transitory computer-readable storage media of any of clauses 8-10, where the first metric comprises a direct-to-reverberant ratio (DRR) metric that is based on a ratio of a maximum peak value of the LSDD spectrum value relative to an average peak value of the LSDD spectrum value.

12. The non-transitory computer-readable storage media of any of clauses 8-11, where the weight value is based on an inverse of the DRR metric.

13. The non-transitory computer-readable storage media of any of clauses 8-12, where generating the first audio spectrum from the first input acoustic signal comprises generating a short-time Fourier transform (STFT) from the first input acoustic signal.

14. In some embodiments, a wearable device comprises a microphone array that receives a first input acoustic signal, and a controller that generates a first audio spectrum from at least the first input acoustic signal, wherein the first audio spectrum includes a set of time-frequency bins, for each time-frequency bin included in the set of time-frequency bins, computes a weighted local space-domain distance (LSDD) spectrum value based on a portion of the first audio spectrum that is included in the time-frequency bin, generates a combined spectrum value based on a set of the weighted LSDD spectrum values computed for the set of time-frequency bins, and determines a first estimated direction of the first input acoustic signal based on the combined spectrum value.

15. The wearable device of any of clause 14, where the microphone array comprises two or more distinct microphones at different locations on the wearable device.

16. The wearable device of clauses 14 or 15, where the two or more distinct microphones receive the first input acoustic signal as least two or more acoustic signals, and the controller adds the two or more acoustic signals to generate a combined input acoustic signal, where the first audio spectrum is generated from the combined input acoustic signal.

17. The wearable device of any of clauses 14-16, where the controller computes the weighted LSDD spectrum value by computing an LSDD spectrum value based on the portion of the first audio spectrum, computing a weight value associated with the portion of the first audio spectrum, and combining the local spectrum value with the weight value to generate the weighted LSDD spectrum value.

18. The wearable device of any of clauses 14-17, where the controller computes the weight value by computing a first metric associated with the portion of the first audio spectrum, and computing a weight value based on the first metric and the LSDD spectrum value.

19. The wearable device of any of clauses 14-18, where the first metric comprises a direct-to-reverberant ratio (DRR) metric that is based on a ratio of a maximum peak value of the LSDD spectrum value relative to an average peak value of the LSDD spectrum value.

20. The wearable device of any of clauses 14-19, where the controller generates the first audio spectrum from the first input acoustic signal by generating a short-time Fourier transform (STFT) from the first input acoustic signal.

Any and all combinations of any of the claim elements recited in any of the claims and/or any elements described in this application, in any fashion, fall within the contemplated scope of the present disclosure and protection.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine. The instructions, when executed via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable gate arrays.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the preceding is directed to embodiments of the present disclosure, other and further embodiments of the disclosure may be devised without departing from the basic scope thereof, and the scope thereof is determined by the claims that follow.

What is claimed is:

1. A computer-implemented method, comprising:

receiving, from a first microphone, a first input acoustic signal;

generating a first audio spectrum from at least the first input acoustic signal, wherein the first audio spectrum includes a set of time-frequency bins;

for each time-frequency bin included in the set of time-frequency bins, computing a weighted local space-domain distance (LSDD) spectrum value based on a portion of the first audio spectrum that is included in the time-frequency bin;

generating a combined spectrum value based on a set of the weighted LSDD spectrum values computed for the set of time-frequency bins; and determining a first estimated direction of the first input acoustic signal based on the combined spectrum value.

2. The computer implemented method of claim 1, wherein computing the weighted LSDD spectrum value comprises:

computing an LSDD spectrum value based on the portion of the first audio spectrum;

computing a weight value associated with the portion of the first audio spectrum; and combining the LSDD spectrum value with the weight value to generate the weighted LSDD spectrum value.

3. The computer-implemented method of claim 2, wherein computing the weight value comprises:

computing a first metric associated with the portion of the first audio spectrum; and computing the weight value based on the first metric and the LSDD spectrum value.

4. The computer-implemented method of claim 3, wherein the first metric comprises a direct-to-reverberant ratio (DRR) metric that is based on a ratio of a maximum peak value of the LSDD spectrum value relative to an average peak value of the LSDD spectrum value.

5. The computer-implemented method of claim 4, wherein the weight value is based on an inverse of the DRR metric.

6. The computer-implemented method of claim 1, wherein generating the first audio spectrum from the first input acoustic signal comprises generating a short-time Fourier transform (STFT) from the first input acoustic signal.

7. The computer-implemented method of claim 1, wherein the first microphone is included in a wearable headset.

8. One or more non-transitory computer-readable storage media including instructions that, when executed by one or more processors, cause the one or more processors to perform the steps of:

receiving, from a first microphone, a first input acoustic signal;

generating a first audio spectrum from at least the first input acoustic signal, wherein the first audio spectrum includes a set of time-frequency bins;

for each time-frequency bin included in the set of time-frequency bins, computing a weighted local space-domain distance (LSDD) spectrum value based on a portion of the first audio spectrum that is included in the time-frequency bin;

generating a combined spectrum value based on a set of the weighted LSDD spectrum values computed for the set of time-frequency bins; and determining a first estimated direction of the first input acoustic signal based on the combined spectrum value.

9. The non-transitory computer-readable storage media of claim 8, wherein computing the weighted LSDD spectrum value comprises:

computing an LSDD spectrum value based on the portion of the first audio spectrum;

computing a weight value associated with the portion of the first audio spectrum; and combining the LSDD spectrum value with the weight value to generate the weighted LSDD spectrum value.

10. The non-transitory computer-readable storage media of claim 9, wherein computing the weight value comprises:

computing a first metric associated with the portion of the first audio spectrum; and computing the weight value based on the first metric and the LSDD spectrum value.

11. The non-transitory computer-readable storage media of claim 10, wherein the first metric comprises a direct-to-reverberant ratio (DRR) metric that is based on a ratio of a maximum peak value of the LSDD spectrum value relative to an average peak value of the LSDD spectrum value.

12. The non-transitory computer-readable storage media of claim 11, wherein the weight value is based on an inverse of the DRR metric.

13. The non-transitory computer-readable storage media of claim 8, wherein generating the first audio spectrum from the first input acoustic signal comprises generating a short-time Fourier transform (STFT) from the first input acoustic signal.

14. A wearable device, comprising:

a microphone array that receives a first input acoustic signal; and a controller that:

generates a first audio spectrum from at least the first input acoustic signal, wherein the first audio spectrum includes a set of time-frequency bins, for each time-frequency bin included in the set of time-frequency bins, computes a weighted local space-domain distance (LSDD) spectrum value based on a portion of the first audio spectrum that is included in the time-frequency bin, generates a combined spectrum value based on a set of the weighted LSDD spectrum values computed for the set of time-frequency bins, and determines a first estimated direction of the first input acoustic signal based on the combined spectrum value.

15. The wearable device of claim 14, wherein the microphone array comprises two or more distinct microphones at different locations on the wearable device.

16. The wearable device of claim 15, wherein:

the two or more distinct microphones receive the first input acoustic signal as least two or more acoustic signals; and the controller adds the two or more acoustic signals to generate a combined input acoustic signal, wherein the first audio spectrum is generated from the combined input acoustic signal.

17. The wearable device of claim 14, wherein the controller computes the weighted LSDD spectrum value by:

computing an LSDD spectrum value based on the portion of the first audio spectrum;

computing a weight value associated with the portion of the first audio spectrum; and combining the LSDD spectrum value with the weight value to generate the weighted LSDD spectrum value.

18. The wearable device of claim 17, wherein the controller computes the weight value by:

computing a first metric associated with the portion of the first audio spectrum; and computing the weight value based on the first metric and the LSDD spectrum value.

19. The wearable device of claim 18, wherein the first metric comprises a direct-to-reverberant ratio (DRR) metric that is based on a ratio of a maximum peak value of the LSDD spectrum value relative to an average peak value of the LSDD spectrum value.

20. The wearable device of claim 14, wherein the controller generates the first audio spectrum from the first input acoustic signal by generating a short-time Fourier transform (STFT) from the first input acoustic signal.

* * * * *